US009981803B2

(12) United States Patent
Davis et al.

(10) Patent No.: US 9,981,803 B2
(45) Date of Patent: May 29, 2018

(54) REFUSE VEHICLE WITH MULTI-SECTION REFUSE EJECTOR

(71) Applicant: Oshkosh Corporation, Oshkosh, WI (US)

(72) Inventors: Emily A. Davis, Rochester, MN (US); Gerard G. Betz, II, Rochester, MN (US)

(73) Assignee: Oshkosh Corporation, Oshkosh, WI (US)

( * ) Notice: Subject to any disclaimer, the term of this patent is extended or adjusted under 35 U.S.C. 154(b) by 165 days.

(21) Appl. No.: 14/928,907

(22) Filed: Oct. 30, 2015

(65) Prior Publication Data

US 2017/0121108 A1 May 4, 2017

(51) Int. Cl.

| | |
|---|---|
| ***B65F 3/20*** | (2006.01) |
| ***B65F 3/28*** | (2006.01) |
| ***B65F 3/04*** | (2006.01) |
| *B65F 3/14* | (2006.01) |

(52) U.S. Cl.

CPC ..... *B65F 3/28* (2013.01); *B65F 3/041* (2013.01); *B65F 3/201* (2013.01); *B65F 3/205* (2013.01); *B65F 2003/146* (2013.01)

(58) Field of Classification Search

CPC .. B65F 3/201; B65F 3/205; B65F 3/28; B65F 3/207; B65F 2003/146

USPC ..... 414/512, 517, 525.6

See application file for complete search history.

(56) References Cited

U.S. PATENT DOCUMENTS

| | | | | |
|---|---|---|---|---|
| 3,865,260 | A * | 2/1975 | Wieschel | B65F 3/28 414/512 |
| 5,378,010 | A | 1/1995 | Marino et al. | |
| 5,951,235 | A | 9/1999 | Young et al. | |
| 6,007,291 | A * | 12/1999 | Ghibaudo | B65F 3/28 414/512 |
| 6,210,094 | B1 * | 4/2001 | McNeilus | B65F 3/201 414/409 |
| 6,315,515 | B1 | 11/2001 | Young et al. | |
| 6,336,783 | B1 | 1/2002 | Young et al. | |
| 6,447,239 | B2 | 9/2002 | Young et al. | |
| 6,565,305 | B2 | 5/2003 | Schrafel | |
| 7,070,382 | B2 | 7/2006 | Pruteanu et al. | |

(Continued)

OTHER PUBLICATIONS

U.S. Appl. No. 14/532,679, filed Nov. 4, 2014, Oshkosh Corporation.

(Continued)

*Primary Examiner* — James Keenan

(74) *Attorney, Agent, or Firm* — Foley & Lardner LLP

(57) ABSTRACT

A refuse vehicle includes a chassis, a body, a primary ejector, and an auxiliary ejector. The chassis includes a frame and a cab disposed at one end of the frame. The body includes a hopper portion and a storage portion. The width of the storage portion is greater than the width of the hopper portion. The auxiliary ejector has a width equal to the difference between the width of the storage portion and the width of the hopper portion. The primary ejector is selectively repositionable within the hopper portion and the storage portion of the body to at least one of compact refuse therein or eject refuse therefrom. The auxiliary ejector is selectively repositionable within the storage portion of the body to at least one of compact refuse therein and eject refuse therefrom in tandem with the primary ejector.

16 Claims, 27 Drawing Sheets

(56) References Cited

U.S. PATENT DOCUMENTS

| | | | | |
|---|---|---|---|---|
| 7,284,943 | B2 | 10/2007 | Pruteanu et al. | |
| 7,452,175 | B2 * | 11/2008 | Martin | B65F 3/201 414/408 |
| 7,489,098 | B2 | 2/2009 | Harris et al. | |
| 7,559,735 | B2 | 7/2009 | Pruteanu et al. | |
| 7,563,066 | B2 * | 7/2009 | Jones | B65F 3/28 414/525.2 |
| 7,671,547 | B2 | 3/2010 | Addleman | |
| 7,683,564 | B2 | 3/2010 | Harris et al. | |
| 7,878,750 | B2 | 2/2011 | Zhou et al. | |
| 7,909,561 | B2 | 3/2011 | Addleman et al. | |
| 8,051,970 | B2 | 11/2011 | Shaber et al. | |
| 8,123,454 | B2 * | 2/2012 | Hallstrom | B65F 3/201 414/525.6 |
| 8,182,194 | B2 | 5/2012 | Pruteanu et al. | |
| 8,360,706 | B2 | 1/2013 | Addleman et al. | |
| 8,540,475 | B2 | 9/2013 | Kuriakose et al. | |
| 8,739,892 | B2 | 6/2014 | Moore et al. | |
| 8,807,613 | B2 | 8/2014 | Howell et al. | |
| 9,139,409 | B2 | 9/2015 | Perron | |
| 9,156,611 | B1 * | 10/2015 | Campbell | B65F 3/201 |
| 9,216,856 | B2 | 12/2015 | Howell et al. | |
| 2007/0138817 | A1 | 6/2007 | Calliari et al. | |
| 2014/0238704 | A1 | 8/2014 | Moore et al. | |
| 2015/0016931 | A1 | 1/2015 | Kuriakose et al. | |
| 2015/0033962 | A1 | 2/2015 | Schwartz et al. | |
| 2015/0175353 | A1 | 6/2015 | Gillmore et al. | |
| 2015/0259185 | A1 | 9/2015 | Ditty | |
| 2016/0009231 | A1 | 1/2016 | Perron et al. | |

OTHER PUBLICATIONS

U.S. Appl. No. 14/552,240, filed Nov. 24, 2014, Oshkosh Corporation.

U.S. Appl. No. 14/552,260, filed Nov. 24, 2014, Oshkosh Corporation.

U.S. Appl. No. 14/552,275, filed Nov. 24, 2014, Oshkosh Corporation.

U.S. Appl. No. 14/552,283, filed Nov. 24, 2014, Oshkosh Corporation.

U.S. Appl. No. 14/552,293, filed Nov. 24, 2014, Oshkosh Corporation.

U.S. Appl. No. 14/693,479, filed Apr. 22, 2015, Oshkosh Corporation.

* cited by examiner

REFUSE VEHICLE WITH MULTI-SECTION REFUSE EJECTOR

BACKGROUND

Refuse vehicles collect a wide variety of waste, trash, and other material from residences and businesses. Operators use the refuse vehicle to transport the material from various waste receptacles within a municipality to a storage facility and/or a processing facility (e.g., a landfill, an incineration facility, a recycling facility, etc.). To reduce the requisite number of trips between the waste receptacles and the storage or processing facility, the refuse may be emptied into a hopper portion of a collection chamber of the refuse vehicle and thereafter compacted into a storage portion of the collection chamber. Such compaction reduces the volume of the refuse and increases the carrying capacity of the refuse vehicle. The refuse is compacted in the collection chamber by an ejector that is forced against the refuse by actuators (e.g., pneumatic cylinders, hydraulic cylinders, etc.). Once the refuse vehicle returns to the storage or processing facility, the refuse may be emptied from the refuse vehicle with the ejector.

Traditional refuse vehicles may be dump bodies or full-eject bodies (e.g., full-ejection, full-pack, etc.). Dump bodies typically utilize actuators (e.g., pneumatic cylinders, hydraulic cylinders, etc.) to elevate a portion of the collection chamber. Once elevated, refuse is influenced by the force of gravity and exits the collection chamber. Full-eject bodies utilize an ejector to expel the refuse from the refuse vehicle and therefore do not require a portion of the collection chamber to be elevated.

Certain refuse vehicles may have a collection chamber with a hopper portion having one width and a storage portion having a different width (e.g., an asymmetrical shape, etc.). By way of example, side-loading refuse vehicles may have such an asymmetrical shape. In these cases, the ejector is traditionally sized according to the width of the hopper portion, leaving a portion of the refuse that may not be adequately compacted in the storage portion, and/or leading to the use of a dump body.

SUMMARY

One embodiment of the present disclosure relates to a refuse vehicle including a chassis, a body, a primary ejector, and an auxiliary ejector. The chassis includes a frame and a cab disposed at one end of the frame. The body includes a hopper portion having a first width and a storage portion having a second width greater than the first width. The hopper portion is positioned forward of the storage portion, between the storage portion and the cab. The primary ejector has a width equal to the first width. The auxiliary ejector has a width equal to the difference between the first width and the second width. The primary ejector is selectively repositionable within the hopper portion and the storage portion of the body to at least one of compact refuse therein and eject refuse therefrom. The auxiliary ejector is selectively repositionable within the storage portion of the body to at least one of compact refuse therein and eject refuse therefrom in tandem with the primary ejector.

Another embodiment of the present disclosure relates to a refuse vehicle including a chassis, a body, a primary ejector, and an auxiliary ejector. The chassis includes a frame and a cab disposed at one end of the frame. The body includes a hopper portion having a first width and a storage portion having a second width greater than the first width. The hopper portion is positioned forward of the storage portion, between the storage portion and the cab. The primary ejector has a width that corresponds to the first width. The combined widths of the primary ejector and the auxiliary ejector correspond with the second width. The primary ejector is selectively repositionable along a primary ejector track extending through the hopper portion and the storage portion. The auxiliary ejector is selectively repositionable along an auxiliary ejector track extending through the storage portion.

Still another embodiment of the present disclosure relates to a side-loading refuse vehicle that includes a chassis, a body, and at least two ejectors. The chassis includes a frame and a cab disposed at one end of the frame. The body includes a storage portion and a hopper portion positioned between the storage portion and the cab. A wall of the body that defines the hopper portion is inset relative to a wall of the body that defines the storage portion such that the body defines a space between the storage portion and the cab, alongside the hopper portion, that is configured to receive a container handling system. A first of the ejectors has a first sweep area extending through the hopper portion and one lateral side of the storage portion of the body. The first sweep area is narrower than the storage portion of the body. A second of the ejectors has a second sweep area extending through a second lateral side of the storage body. The second sweep area is disposed rearward of the space defined by the body that is configured to receive the container handling system such that the second ejector sweeps a dead zone not accessible to the first ejector.

The invention is capable of other embodiments and of being carried out in various ways. Alternative exemplary embodiments relate to other features and combinations of features as may be recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a refuse vehicle includes a primary ejector and an auxiliary ejector designed to increase the amount of refuse that may be compacted in a refuse vehicle and designed to the amount of refuse that may be expelled from a vehicle. The auxiliary ejector may be positioned to one lateral side of the primary ejector and facilitate packing refuse in a side-loading refuse vehicle. A side-loading refuse vehicle may have a primary ejector to compact and expel refuse. To increase storage, refuse vehicles may have a collection system that is inset with wider refuse body walls. An auxiliary ejector cooperates with the primary ejector to expel more refuse without increasing vehicle width, which may be regulated by local, state, or federal agencies defining a maximum overall vehicle width (e.g., a maximum overall width for a vehicle on certain roadways, etc.). The collection chamber of the refuse vehicle may have an asymmetrical shape, and the auxiliary ejector may improve performance by compensating for the dead zone within which a traditional ejector may not fully eject refuse (e.g., along one side of the collection chamber, etc.). Additionally, a traditional ejector may not be able to fully compact refuse in the collection chamber. Minimizing the effects of the asymmetrical collection chamber thereby allows for a corresponding increase in the cargo capacity of the refuse vehicle (e.g., as measured in terms of available volume, etc.). Increasing the amount of refuse that may be compacted in and expelled from a refuse vehicle increases the cargo-capacity of the refuse vehicle and thereby increases the efficiency of the refuse vehicle.

Figure 1:
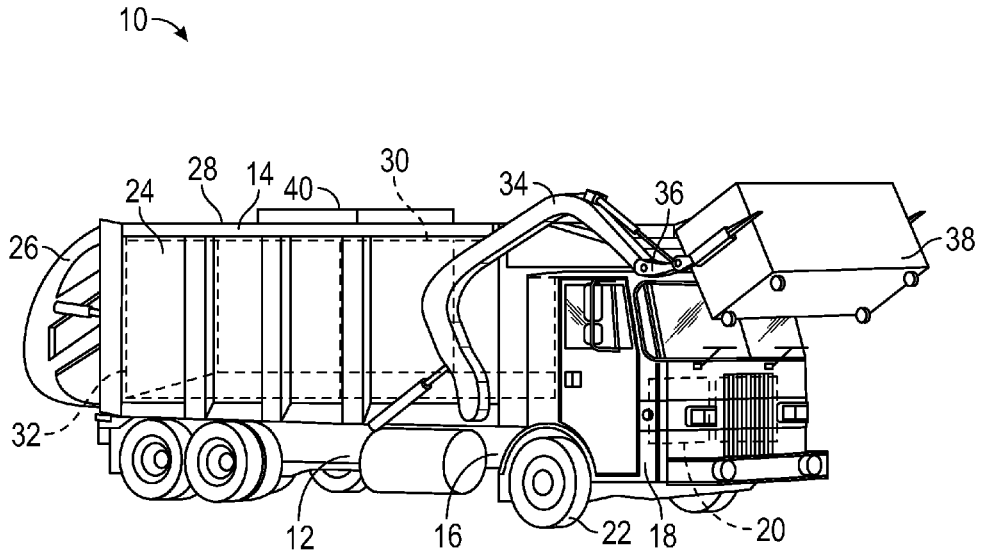
FIG. 1 is a perspective view of a front-loading refuse vehicle, according to an exemplary embodiment of the present disclosure.
Figure 2:
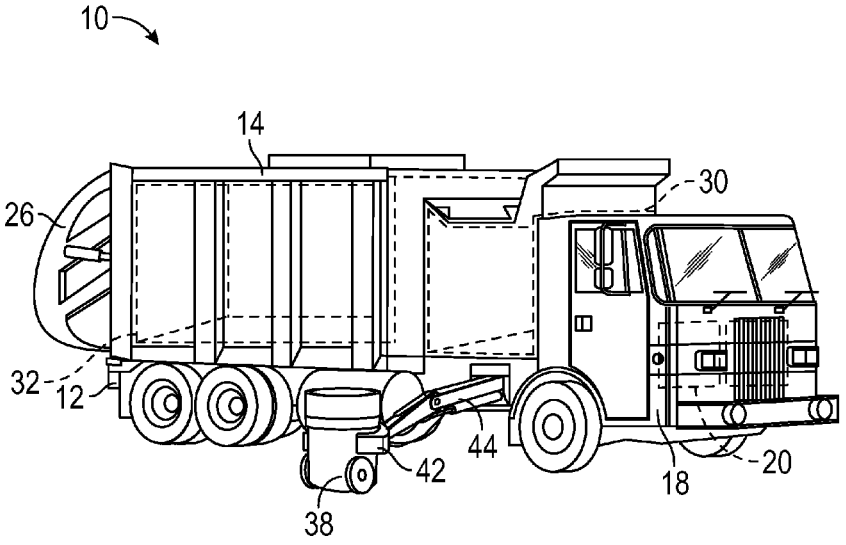
FIG. 2 is a perspective view of a side-loading refuse vehicle, according to an exemplary embodiment of the present disclosure.
Figure 3:
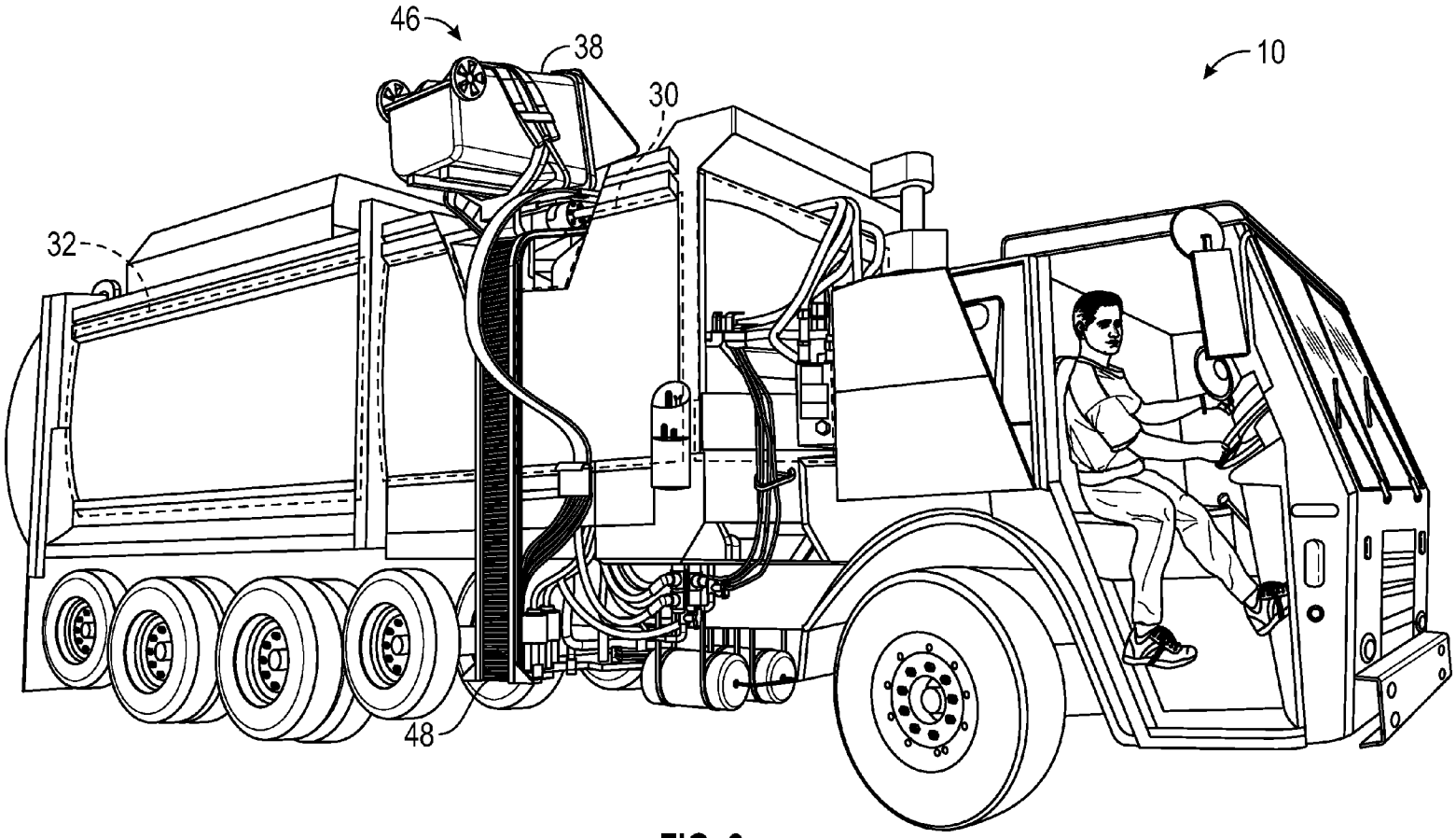
FIG. 3 is a perspective view of a zero-radius side-loading refuse vehicle, according to an exemplary embodiment of the present disclosure.

Referring to FIGS. 1-3, a vehicle, shown as refuse vehicle 10 (e.g., refuse truck, garbage truck, waste collection truck, sanitation truck, etc.), includes a support structure, shown as chassis 12 and a structural body, shown as body 14. Body 14 may be of various shapes, sizes, and configurations to accommodate different styles and variations of refuse vehicle 10. Body 14 may have two generally lateral sides running substantially parallel from a front end of body 14 to a back end of body 14 (e.g., relative to a primary direction of travel of refuse vehicle 10, etc.). Chassis 12 includes a foundational structure, shown as frame 16, and an occupancy compartment, shown as cab 18.

As shown in FIGS. 1-3, cab 18 is coupled to a front end of frame 16. Cab 18 includes various components to facilitate operation of refuse vehicle 10 by an operator (e.g., a seat, a steering wheel, hydraulic controls, etc.). In one embodiment, refuse vehicle 10 further includes a prime mover 20 coupled to frame 16 at a position beneath cab 18. Prime mover 20 provides power to a plurality of motive members, shown as wheels 22, and to other systems of the vehicle (e.g., a pneumatic system, a hydraulic system, etc.). Prime mover 20 may be configured to utilize a variety of fuels (e.g., gasoline, diesel, bio-diesel, ethanol, natural gas, etc.), according to various exemplary embodiments. According to an alternative embodiment, prime mover 20 is one or more electric motors. The electric motors may consume electrical power from an on-board storage device (e.g., batteries, ultra-capacitors, etc.), from an on-board generator (e.g., an internal combustion engine, thermoelectric generator, etc.), and/or from an external power source (e.g., overhead power lines, electromagnetic radiation, etc.) and provide power to the systems of the refuse vehicle 10.

According to an exemplary embodiment, refuse vehicle 10 is configured to transport refuse from various waste receptacles within a municipality to a storage facility and/or a processing facility (e.g., a landfill, an incineration facility, a recycling facility, etc.). As shown in FIGS. 1-3, body 14 includes panels 24, a tailgate 26, and a cover 28. Panels 24, tailgate 26, and cover 28 define a chamber that includes a collection chamber, shown as hopper portion 30, and a storage chamber, shown as storage portion 32. Loose refuse is placed into hopper portion 30 and is thereafter compacted into storage portion 32. Hopper portion 30 and storage portion 32 provide temporary storage for refuse during transport to a waste disposal site and/or a recycling facility. In some embodiments, at least a portion of body 14 extends in front of cab 18. According to the embodiments shown in FIGS. 1-3, body 14 is positioned behind cab 18. According to an exemplary embodiment, hopper portion 30 is positioned between storage portion 32 and cab 18 (i.e., refuse is initially loaded into a position behind cab 18 and stored in a position further toward the rear of refuse vehicle 10).

Referring again to the exemplary embodiment shown in FIG. 1, refuse vehicle 10 is a front-loading refuse vehicle. As shown in FIG. 1, refuse vehicle 10 includes a pair of arms 34 coupled to frame 16 on either side of cab 18. Arms 34 may be rotatably coupled to frame 16 with a pivot (e.g., a lug, a shaft, etc.). In some embodiments, actuators (e.g., hydraulic cylinders, pneumatic cylinders, etc.) are coupled to frame 16 and arms 34, and extension of the actuators rotates arms 34 about an axis extending through the pivot. According to an exemplary embodiment, interface members, shown as a container handling system 36, are coupled to arms 34. Arms 34 may have a generally rectangular cross-sectional shape and are configured to engage a container, shown as refuse container 38, (e.g., protrude through apertures within refuse container 38, etc.).

Refuse container 38 may be rectangular (e.g., an industrial refuse container, a commercial refuse container, a residential refuse container, a trash can, etc.), cylindrical (e.g., a residential refuse container, refuse bin, refuse can, a trash can, a ninety-six galleon refuse container, etc.), prismatic, or of any other shape for the storage of refuse, and may be thereby tailored for a target application. During operation of refuse vehicle 10, container handling system 36 is positioned to engage refuse container 38 (e.g., refuse vehicle 10 is driven into position until container handling system 36 protrude through the apertures within refuse container 38). As shown in FIG. 1, arms 34 are rotated to lift refuse container 38 over cab 18. A second actuator (e.g., a hydraulic cylinder, pneumatic cylinder, etc.) articulates container handling system 36 to tip the refuse out of refuse container 38 and into hopper portion 30 through an opening in cover 28. The actuator thereafter rotates arms 34 to return the empty refuse container 38 to the ground. According to an exemplary embodiment, a top door 40 is slid along cover 28 to seal the opening thereby preventing refuse from escaping refuse vehicle 10 (e.g., due to wind, inertia, etc.).

Referring to the exemplary embodiment shown in FIG. 2, refuse vehicle 10 is a side-loading refuse vehicle that includes a container handling system, shown as container handling system 42, configured to interface with (e.g., engage, wrap around, etc.) refuse container 38. According to the exemplary embodiment shown in FIG. 2, container handling system 42 is movably coupled to body 14 with an arm 44. Arm 44 includes a first end coupled to body 14 and a second end coupled to container handling system 42. An actuator (e.g., a hydraulic cylinder, pneumatic cylinder, etc.) articulates arm 44 and positions a portion of container handling system 42 to interface with refuse container 38. Arm 44 may be moveable in one or more directions (e.g., up and down, left and right, in and out, rotation, etc.) to facilitate positioning the portion of container handling system 42 to interface with refuse container 38.

Referring to the exemplary embodiment shown in FIG. 3, refuse vehicle 10 is a zero-radius (e.g., ZR, etc.) side-loading refuse vehicle that includes a container handling system, shown as container handling system 46, movably coupled to body 14 with a track mechanism 48. After interfacing with refuse container 38, container handling system 46 is elevated along track 48 (e.g., with a cable, with a hydraulic cylinder, with a rotational actuator, etc.). Track 48 may include a curved portion at an upper portion of body 14 such that container handling system 46 and refuse container 38 are tipped toward hopper portion 30 of refuse vehicle 10.

As container handling system 42 or 46 is tipped, refuse falls through an opening in cover 28 and into hopper portion 30 of refuse vehicle 10. Arm 44 then returns the empty refuse container 38 to the ground, and top door 40 may be slid along cover 28 to seal the opening, thereby preventing refuse from escaping body 14 (e.g., due to wind, inertia, etc.).

Figure 4:
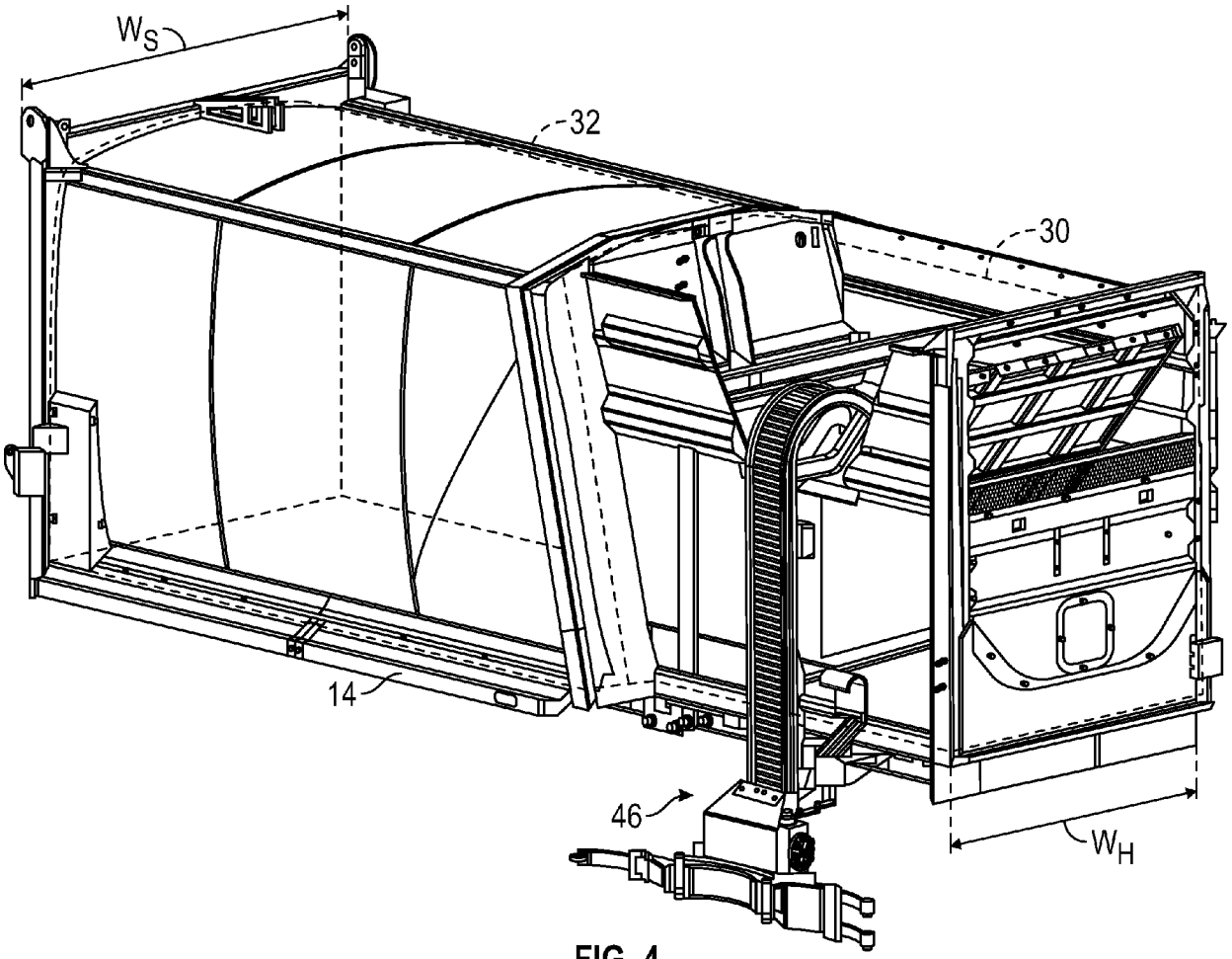
FIG. 4 is a perspective view of a body for a refuse vehicle, according to an exemplary embodiment of the present disclosure.
Figure 5:
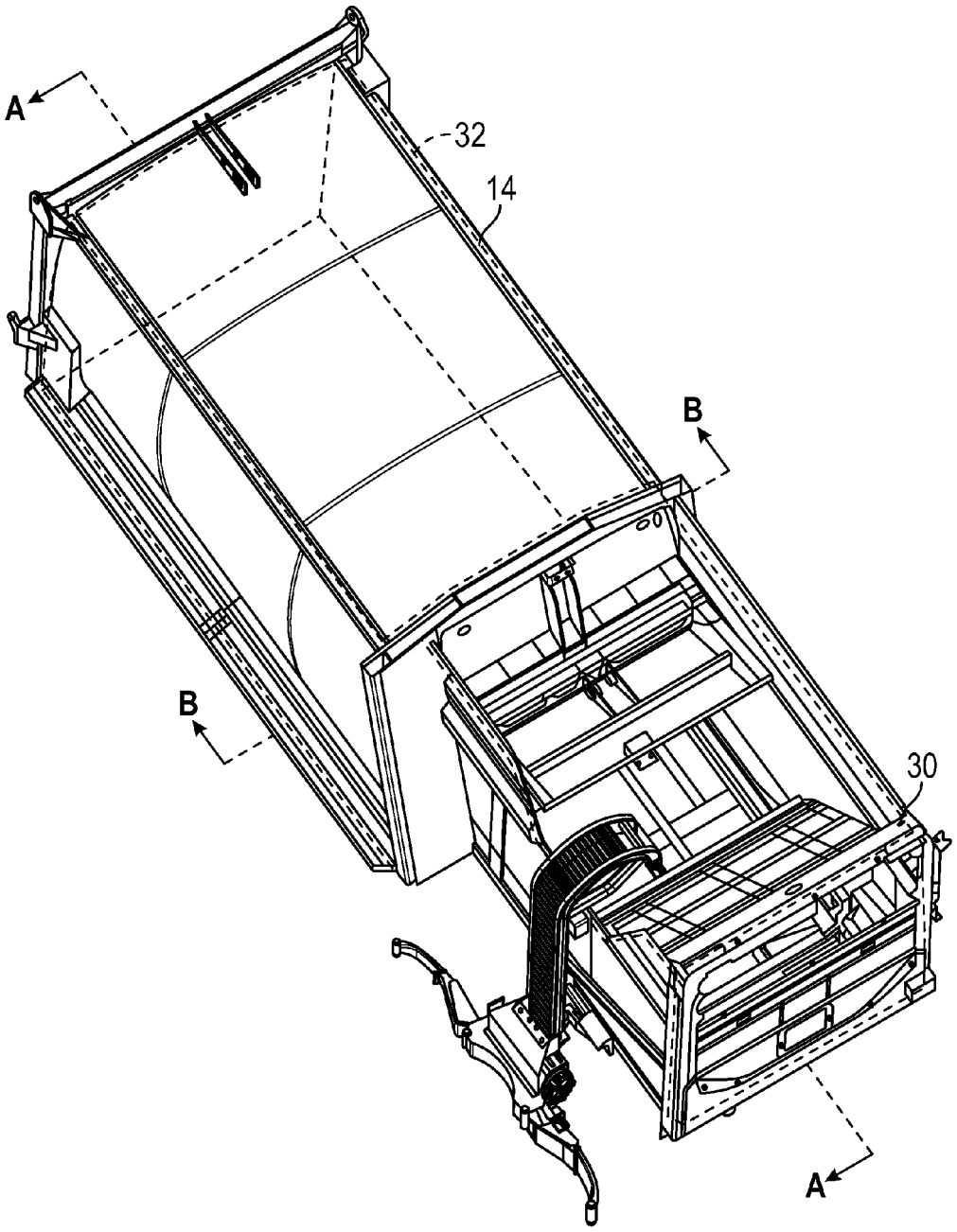
FIG. 5 is a top perspective view of the body for a refuse vehicle, according to an exemplary embodiment of the present disclosure.

Referring next to FIGS. 4-5, body 14 of refuse vehicle 10 includes hopper portion 30, storage portion 32, and container handling system 46. According to various embodiments, body 14 has an asymmetrical body shape (e.g., a shape that is not symmetric about a vertical plane extending along a length of body 14, etc.). Hopper portion 30 has a width, $W_H$, and storage portion 32 has a width, $W_S$. According to various embodiments, the width of hopper portion 30, $W_H$, is less than the width of storage portion 32, $W_S$. As shown in FIGS. 4-5, container handling system 46 is configured for use with a zero-radius side-loading refuse vehicle.

Referring next to the exemplary embodiments shown in FIGS. 6-13, refuse vehicle 10 includes one or more of a first packer (e.g., ram, pusher, etc.), shown as first primary ejector 48, a second packer (e.g., ram, pusher, etc.), shown as a second primary ejector 50, and a third packer (e.g., ram, pusher, etc.), shown as first auxiliary ejector 52. First primary ejector 48, second primary ejector 50, and first auxiliary ejector 52 may be translated by an actuator (e.g., a hydraulic cylinder, a pneumatic cylinder, etc.). First primary ejector 48, second primary ejector 50, and/or first auxiliary ejector 52 may be additionally or alternatively translated by a gear train, a rack and pinion mechanism, or other mechanical, electromechanical, or magnetic mechanism, and may be thereby tailored for a target application.

First primary ejector 48, second primary ejector 50, and first auxiliary ejector 52 may be configured to compact refuse within refuse vehicle 10 and/or to eject refuse from refuse vehicle 10. Refuse vehicle 10 may automatically (e.g., autonomously, independently, etc.) compact refuse within refuse vehicle 10 and/or eject refuse from refuse vehicle 10 when certain conditions are met (e.g., when a certain amount of refuse is detected, when a certain location is reached, etc.) and/or such control may occur in response to user input.

According to an exemplary embodiment, body 14 of refuse vehicle 10 includes a first post, shown as front post 54, a second post, shown as mid post 56, and a third post, shown as rear post 58. Front post 54, mid post 56, and/or rear port 58 may be positioned at known locations and may include a structure member and/or a location identification device, such as a radio-frequency identification chip or tag, a hall-effect sensor, a proximity sensor, a mechanical, electrical, or electromechanical switch, or other location identifying device, and may be thereby tailored for a target application. According to an exemplary embodiment, rear post 58 is disposed at the rear of body 14 on a lateral side of refuse vehicle 10. When compacting refuse, first primary ejector 48, second primary ejector 50, and/or first auxiliary ejector 52 may compact refuse from hopper portion 30 into storage portion 32. According to various embodiments, first auxiliary ejector 52 is controlled to only eject refuse from refuse vehicle 10. According to various embodiments, first auxiliary ejector 52 is controlled to both eject refuse from refuse vehicle 10 and to compact refuse within refuse vehicle 10. The auxiliary ejector substantially increases the carrying capacity of a refuse vehicle having an asymmetrical body, thereby increasing the efficiency of refuse operations. The auxiliary ejector therefore facilitates the use of many different configurations of asymmetrical body shapes while allowing for a common body architecture. The auxiliary ejector therefore improves manufacture because the common body architecture results in more rapid and cost-effective manufacturing across product lines.

According to various exemplary embodiments, refuse vehicle 10 is a side-loading refuse vehicle. However, according to various alternative embodiments, refuse vehicle 10 is a front-loading refuse vehicle. Still further, refuse vehicle 10 may be a rear-loading or a top-loading refuse vehicle. Refuse vehicle 10 may have an asymmetrical body shape and have a configuration tailored for any given application. For example, refuse vehicle 10 may have an asymmetrical body shape having a wall thereof inset an inset distance to accommodate differing styles of container handling systems. The auxiliary ejector may have a width tailored for various insets (i.e., the width of the auxiliary ejector may be adjusted to correspond with the inset distance, thereby facilitating manufacture because the primary ejector of a common width may be utilized across different product lines having different inset distances).

Figure 6:
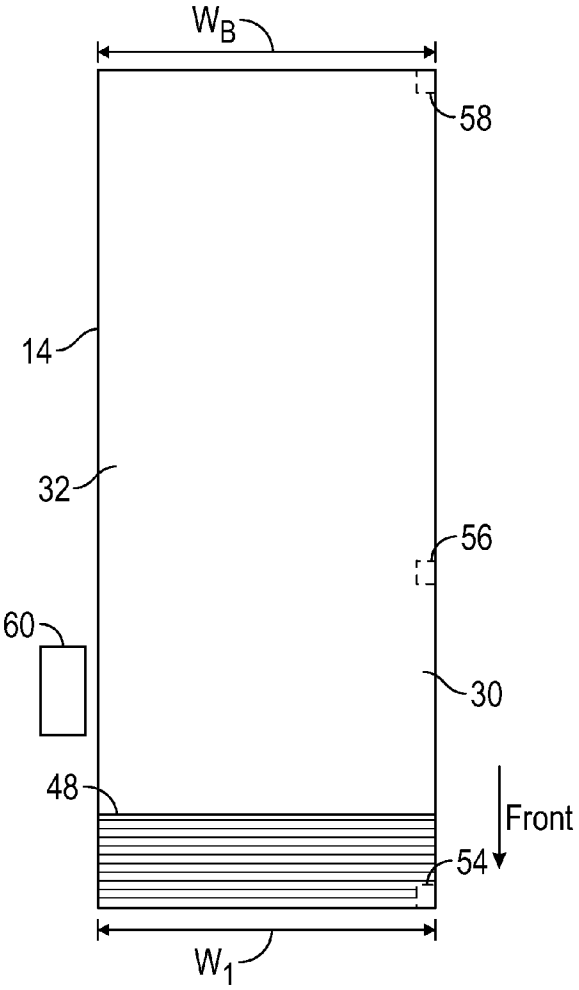
FIG. 6 is a schematic view of a primary ejector mounted within a body of a side-loading refuse vehicle.

As shown in FIG. 6, body 14 of refuse vehicle 10 is symmetrical, and refuse vehicle 10 includes a single container handling system 60 (e.g., a side-loading container handling system, a zero-radius container handling system, a manual refuse input for use by an operator, etc.). Refuse vehicle 10 may contain only first primary ejector 48. As illustrated in FIG. 6, first primary ejector 48 may be initially disposed along the front end of body 14 of refuse vehicle 10. First primary ejector 48 may have a width, $W_1$, and body 14 may have a width, $W_B$. The width, $W_1$, of first primary ejector 48 may be narrower than the width, $W_B$, of body 14 by a spacing distance. This spacing distance may facilitate the operation of first primary ejector 48 and accommodate clearances, hardware interfaces, and/or other dimensional constraints. The difference between the width, $W_1$, of first primary ejector 48 and the width, $W_B$, of body 14 may be such that refuse is substantially confined to the area defined by the rearward face, in relation to a primary direction of travel of refuse vehicle 10, of first primary ejector 48 and body 14. In operation refuse vehicle 10 may deposit refuse into hopper portion 30 through the use of container handling system 60 and then either compact refuse into storage portion 32 or eject refuse from refuse vehicle 10. Further, first primary ejector 48 may move from front post 54, past mid post 56, and then to rear post 58. A refuse vehicle having a symmetrical body and containing an ejector having a width substantially the same as the width of the body may be a "full-eject" refuse vehicle.

Figure 7:
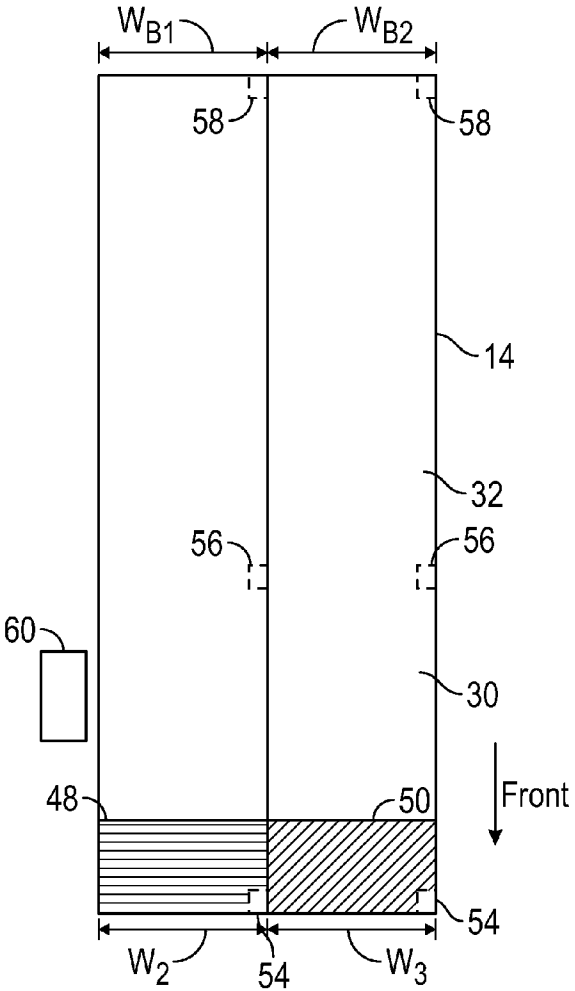
FIG. 7 is a schematic view of multiple primary ejectors mounted within a dual-stream body of a side-loading refuse vehicle.
Figure 8:
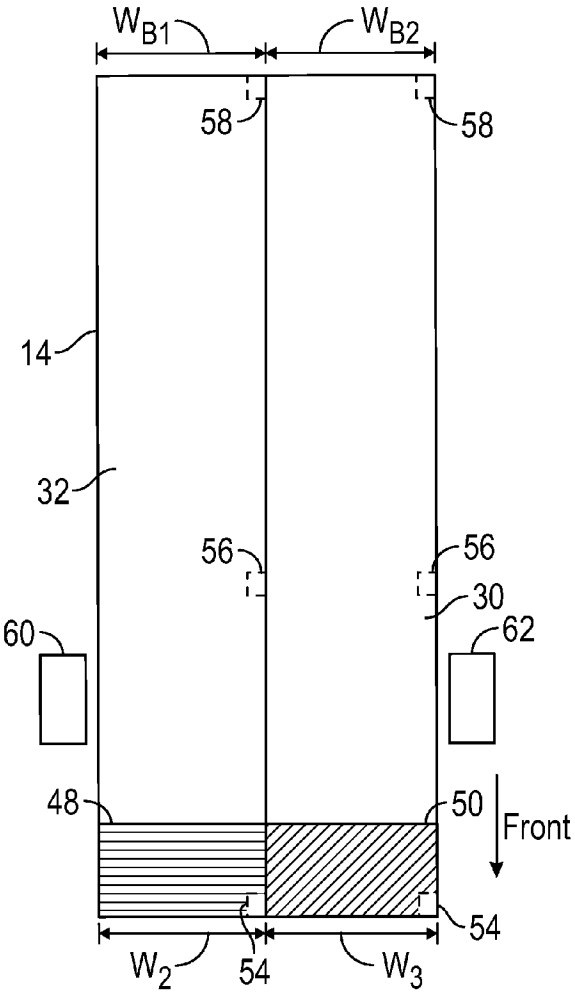
FIG. 8 is a schematic view of multiple primary ejectors mounted within a body of a side-loading refuse vehicle that includes container handling systems disposed on either side of the body.

As shown in FIGS. 7-8, body 14 of refuse vehicle 10 is divided into two sections and includes first primary ejector 48 and second primary ejector 50. Body 14 of refuse vehicle may be divided into three, four, or more sections and thereby tailored for a target application. A refuse vehicle with a body being divided into two sections may be a "multi-stream" (e.g., split stream, dual-stream, bi-stream, etc.) refuse vehicle. In operation, the multi-stream refuse vehicles may utilize one section for one type of refuse, such as refuse (e.g., garbage, trash, etc.), and the other section for recyclables (e.g., recycling, recyclable plastics, organics, etc.). First primary ejector 48 may have a width, $W_2$, and second primary ejector 50 may have a width, $W_3$. Body 14 may have two sections, one having a width, $W_{B1}$, and the other having a width, $W_{B2}$. In operation, first primary ejector 48 and second primary ejector 50 may move from front post 54, past mid post 56, and then to rear post 58. The first primary ejector 48 may be actuated to move independent of the second primary ejector 50, though movement of first primary ejector 48 may alternatively correspond to movement of second primary ejector 50.

The width, $W_2$, of first primary ejector 48 may be narrower than the width, $W_{B1}$, of one section of body 14 by a spacing distance. This spacing distance may facilitate the operation of first primary ejector 48 and accommodate clearances, hardware interfaces, and/or other dimensional constraints. The difference between the width, $W_2$, of first primary ejector 48 and the width, $W_{B1}$, of one section of body 14 may be such that refuse is substantially confined to the area defined by the rearward face, in relation to a primary direction of travel of refuse vehicle 10, of first primary ejector 48 and one section of body 14. The width, $W_3$, of second primary ejector 50 may be narrower than the width, $W_{B2}$, of one section of body 14 by a spacing distance. This spacing distance may facilitate the operation of second primary ejector 50 and accommodate clearances, hardware interfaces, and/or other dimensional constraints. The difference between the width, $W_3$, of second primary ejector 50 and the width, $W_{B2}$, of one section of body 14 may be such that refuse is substantially confined to the area defined by the rearward face, in relation to a primary direction of travel of refuse vehicle 10, of second primary ejector 50 and one section of body 14. Width $W_{B1}$ and width $W_{B2}$ of body 14 may be equivalent to, greater than, or less than each other. Corresponding width $W_2$ of first primary ejector 48 and width $W_3$ of second primary ejector 50 may therefore also be equivalent to, greater than, or less than each other.

Referring to FIG. 8, the system further includes a second container handling system 62 (e.g., a side-loading container handling system, a zero-radius side-loading container handling system, a manual refuse input for use by an operator, etc.). In some applications, the use of multiple container handling systems may be advantageous to the operation of refuse vehicle 10. For instance, refuse vehicle 10 may include container handling system 60 and second container handling system 62 in order to efficiently collect multiple refuse containers in one stop, or may collect refuse containers from opposite sides of a narrow alleyway without turning around and going back down the alleyway. In this manner, incorporating container handling 60 and/or container handling system 62 is advantageous to the refuse vehicle. However, incorporating certain container handling systems may not permit the use of a symmetrical body in a refuse vehicle.

Referring to FIGS. 9-14, body 14 of refuse vehicle 10 is asymmetrical. A refuse vehicle may have an asymmetrical body in order to accommodate the storage of a container handling system, such as container handling system 60. A refuse vehicle having an auxiliary ejector may maximize the internal volume of the refuse vehicle, while staying within the regulated maximum overall width (e.g., one-hundred and two inches, etc.). As shown in FIGS. 9-14, the storage of container handling system 60 within body 14 the width of storage portion 32 differs from width of hopper portion 30. Storage portion 32 of body 14 may have a width $W_S$, and hopper portion 30 of body 14 may have a width $W_H$, where each width is measured in the direction perpendicular to a primary direction of travel of the refuse vehicle.

As shown in FIGS. 9-14, the width $W_S$ of storage portion 32 is wider than the width $W_H$ of hopper portion 30 by a spacing distance. This spacing distance may facilitate the operation of first primary ejector 48 and accommodate clearances, hardware interfaces, and/or other dimensional constraints. The difference between the width $W_4$ of first primary ejector 48 and the width $W_H$ of hopper portion 30 may be such that refuse is substantially confined to the area rearward of the rearward face, in relation to a primary direction of travel of refuse vehicle 10, of first primary ejector 48 and body 14.

Figure 9:
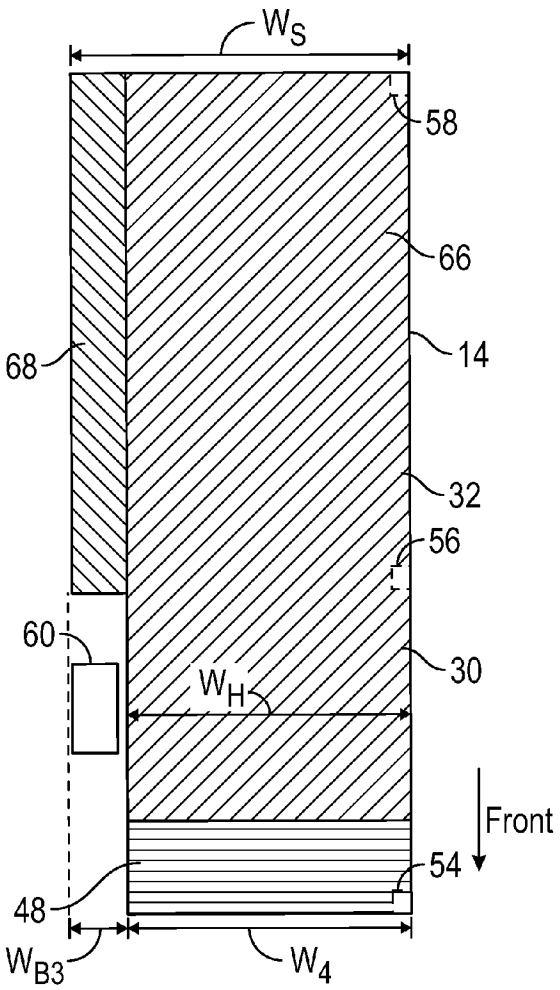
FIG. 9 is a schematic view of a primary ejector mounted within an asymmetrical body of a side-loading refuse vehicle, a first sweep area, and a dead zone of the first primary ejector, according to an exemplary embodiment of the present disclosure.

Referring to FIG. 9, body 14 of refuse vehicle 10 includes first primary ejector 48. In operation, first primary ejector 48 may have a width $W_4$ which is less than the width $W_S$ of storage portion 32, where the difference is width $W_5$. Refuse may not be adequately compacted in, or ejected from, storage portion 30 due to the difference in the width $W_4$ of first primary ejector 48 and the width $W_S$ of storage portion 32. First primary ejector 48 may have an effective region, shown as a first sweep area 66, which may result in a non-contact area, shown as a dead zone 68. Both first sweep area 66 and dead zone 68 may be functions of the widths of first primary ejector 48, hopper portion 30, and storage portion 32. In first sweep area 66, first primary ejector 48 may contact refuse and may therefore compact in or eject refuse from, refuse vehicle 10. However, first primary ejector 48 may not engage refuse in dead zone 68 and therefore may not compact refuse therein or eject refuse therefrom. As a result of using only a primary ejector in an asymmetrical body, a refuse vehicle may have a reduced carrying capacity and, therefore, a reduced efficiency in refuse operations.

Figure 10:
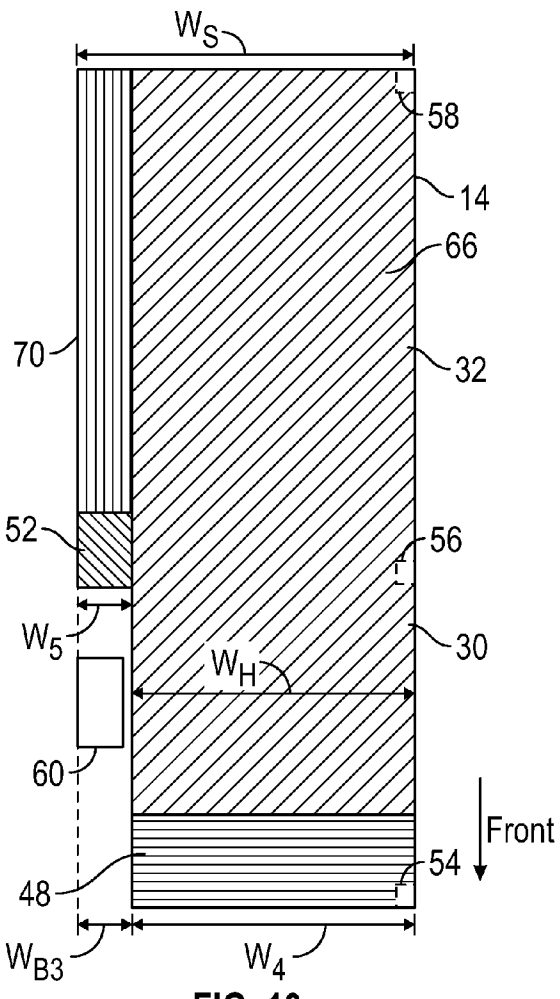
FIG. 10 is a schematic view of a primary ejector and an auxiliary ejector mounted within an asymmetrical body of a side-loading refuse vehicle where both the primary ejector and first auxiliary ejector are in refracted orientations, according to an exemplary embodiment of the present disclosure.

Referring to FIGS. 10-14, body 14 of refuse vehicle 10 includes first primary ejector 48 and first auxiliary ejector 52. According to an exemplary embodiment, the width $W_5$ of first auxiliary ejector 52 is narrower than the width $W_{B3}$ of a section of body 14 by a spacing distance. This spacing distance may facilitate the operation of first auxiliary ejector 52 and accommodate clearances, hardware interfaces, and/or other dimensional constraints. Referring specifically to FIG. 10, first auxiliary ejector 52 has an effective region, shown as a second sweep area 70. In one embodiment, first auxiliary ejector 52 is configured such that second sweep area 70 is substantially equivalent to dead zone 68 of first primary ejector 48, as shown in FIG. 9. The width of second sweep area 70 may be a function of the width of dead zone 68 and therefore a function of the widths of first primary ejector 48, hopper portion 30, and storage portion 32.

While in FIGS. 10-14 a gap (e.g., space, spacing, etc.) is not shown between first primary ejector 48 and first auxiliary ejector 52, and corresponding first sweep area 66, and second sweep area 70, a small gap may exist to facilitate the operation of first primary ejector 48 and/or first auxiliary ejector 52 and accommodate clearances, hardware interfaces, and/or other dimensional constraints. In application, virtually no gap may exist between first primary ejector 48 and first auxiliary ejector 52, and corresponding first sweep area 66 and second sweep area 70, or between first primary ejector 48 and body 14, or between first auxiliary ejector 52 and body 14.

Figure 11:
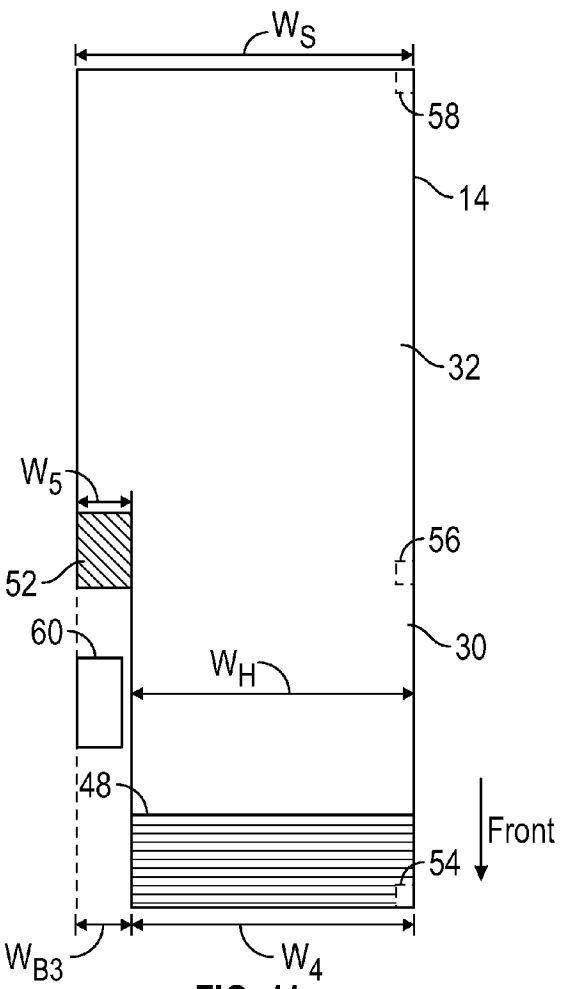
FIG. 11 is a schematic view of the primary ejector and the auxiliary ejector shown in FIG. 10, showing a first sweep area of the primary ejector and a second sweep area of the auxiliary ejector, according to an exemplary embodiment of the present disclosure.
Figure 13:
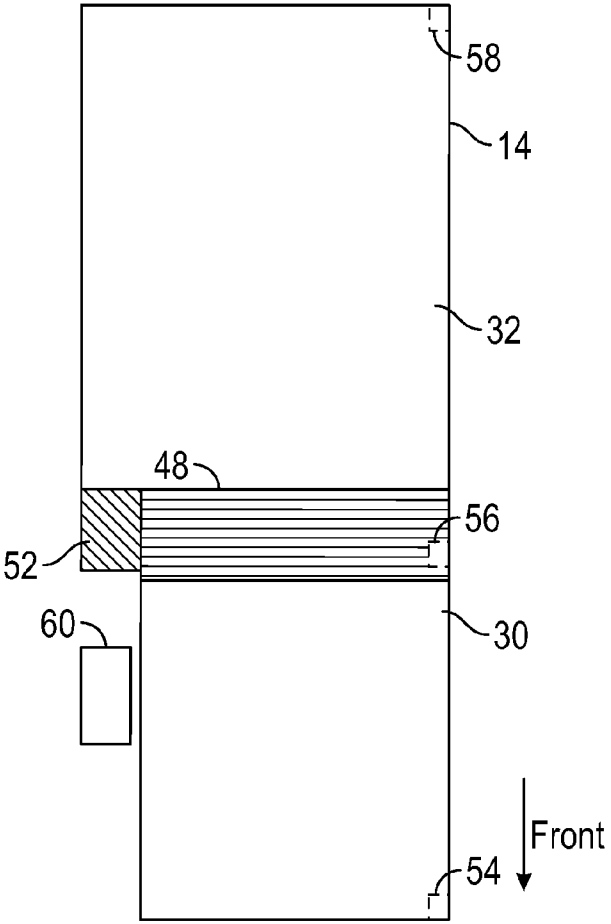
FIG. 13 is a schematic view of the primary ejector and first auxiliary ejector shown in FIG. 10, where the primary ejector is aligned with the auxiliary ejector, according to an exemplary embodiment of the present disclosure.
Figure 12:
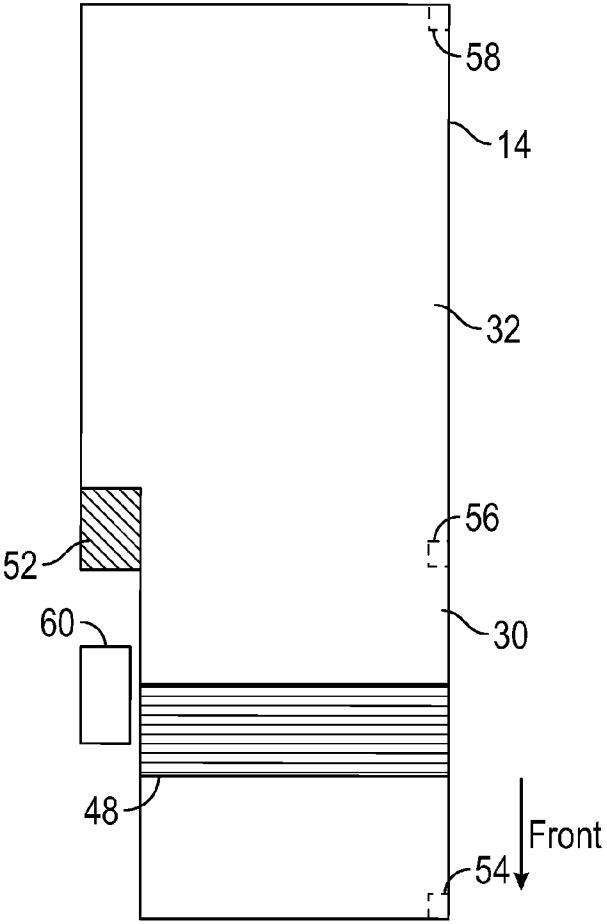
FIG. 12 is a schematic view of the primary ejector and the auxiliary ejector shown in FIG. 10, where the primary ejector has been partially extended and the auxiliary ejector is in a retracted orientation, according to an exemplary embodiment of the present disclosure.

An operation of first primary ejector 48 and first auxiliary ejector 52 is illustrated in FIGS. 11-14. In FIG. 11, first primary ejector 48 is in a retracted orientation (e.g., at front post 54, etc.), while first auxiliary ejector 52 is in a retracted orientation (e.g., at mid post 56, etc.). In FIG. 12, first primary ejector 48 has been partially extended and has translated and compacted refuse from hopper portion 30 into storage portion 32. As first primary ejector 48 moves through hopper portion 30, first auxiliary ejector 52 remains in a retracted orientation. In FIG. 13, first primary ejector 48 has moved through hopper portion 30 and is now at mid post 56, such that the faces (e.g., rearward faces, etc.) of first primary ejector 48 and first auxiliary ejector 52 are substantially aligned.

Figure 14:
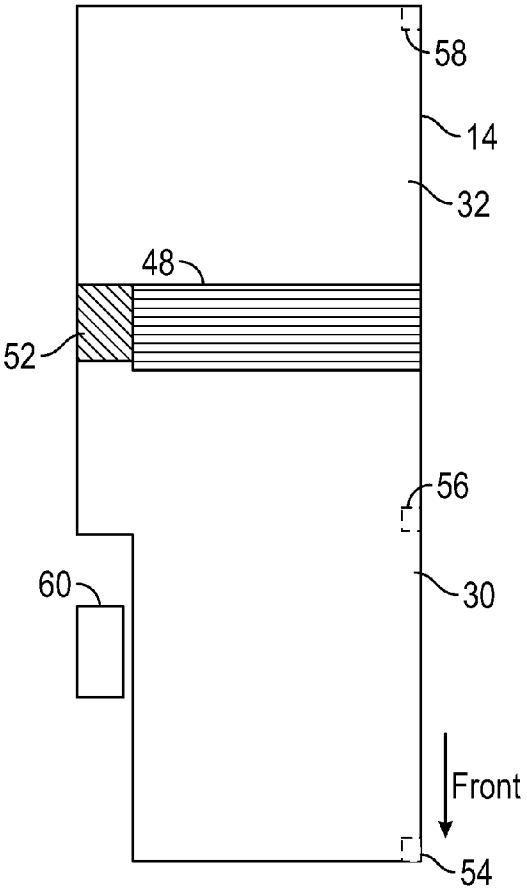
FIG. 14 is a schematic view of the primary ejector and the auxiliary ejector shown in FIG. 10 moving in tandem to an intermediate location, according to an exemplary embodiment of the present disclosure.

According to an exemplary embodiment, once both first primary ejector 48 and first auxiliary ejector 52 are at mid post 56, a coupling process is initiated such that the further rearward movement of first primary ejector 48, in relation to a primary direction of travel of refuse vehicle 10, prompts rearward movement of first auxiliary ejector 52 *w*. In FIG. 14, first primary ejector 48 is moving in tandem with first auxiliary ejector 52 (e.g., with the rearward faces of first primary ejector 48 and first auxiliary ejector 52 substantially aligned, etc.). According to various alternative embodiments, a spacing distance may be introduced such that when movement of first primary ejector 48 and first auxiliary ejector 52 occurs, the rearward faces, in relation to a primary direction of travel of refuse vehicle 10, of first primary ejector 48 and rearward ejector 52 are not substantially aligned. According to the embodiments shown in FIGS. 11-14, movement of the first primary ejector 48 and first auxiliary ejector 52 is configured to terminate when first primary ejector 48 and/or first auxiliary ejector 52 are at rear post 58. However, in some applications, movement of first primary ejector 48 and/or first auxiliary ejector 52 may extend beyond rear post 58 a target distance. For example, movement of first primary ejector 48 and/or first auxiliary ejector 52 may extend beyond rear post 58 to facilitate full ejection of refuse from refuse vehicle 10.

In some embodiments, first primary ejector 48 and first auxiliary ejector 52 are configured to de-couple at a target point along the travel of first primary ejector 48 and/or first auxiliary ejector 52. The target point may be established through the use of an auxiliary post. First primary ejector 48 and first auxiliary ejector 52 may also re-couple at the target point in the travel of first primary ejector 48 and/or first auxiliary ejector 52. According to various embodiments, first primary ejector 48 and first auxiliary ejector 52 are controlled to operate independent from one another. In these embodiments, the operator or other on-board system determines whether coupling of first primary ejector 48 and first auxiliary ejector 52 will occur, and, if so, at which desired parameters (e.g., location, velocity, time, etc.) coupling will occur. In one embodiment, coupling of the first primary ejector 48 and the first auxiliary ejector 52 occurs at mid post 56.

Figure 15:
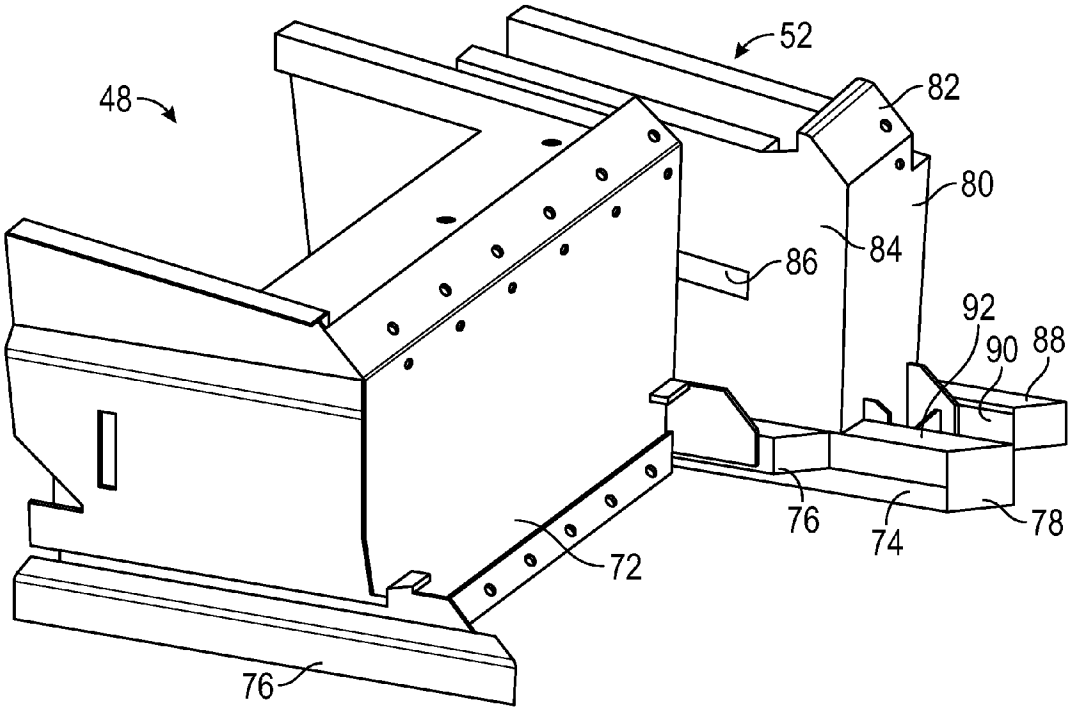
FIG. 15 is a perspective view of the primary ejector and the auxiliary ejector shown in FIGS. 10-13, according to an exemplary embodiment of the present disclosure.

FIGS. 15-24 illustrate various arrangements of first primary ejector 48 and/or first auxiliary ejector 52 including various coupling mechanisms and associated elements. Referring specifically to FIG. 15, first primary ejector 48 is decoupled from first auxiliary ejector 52. As shown in FIG. 15, first primary ejector 48 includes front plate 72 and is mounted to a track, shown as a primary ejector track 74 through the use of an ejector shoe 76 and a shoe stop plate 78. According to the exemplary embodiment of FIG. 15, first auxiliary ejector 52 includes front plate 80, top plate 82, side plate 84, hole 86, and is mounted to a track, shown as auxiliary ejector track 88, through the use of an ejector shoe 90 and a shoe stop plate 91. Primary ejector track 74 and auxiliary ejector track 88 are configured such that both first primary ejector 48 and first auxiliary ejector 52 share a common track body 92 that includes primary ejector track 74 and auxiliary ejector track 88.

It is understood that while FIGS. 15-28 illustrate particular geometries and configurations of first primary ejector 48, first auxiliary ejector 52, and associate elements, other shapes, sizes, and geometries could additionally be employed. For example, FIG. 15 illustrates an example where shoe stop plate 78 and corresponding ejector shoe 76 are substantially angled. Depending on the application, shoe stop plate 78 and corresponding ejector shoe 76 may be of different geometries and may also be dissimilar in geometry. Other pairings of ejector shoes and shoe stop plates may also be of different geometries and may also be dissimilar. Hole 86 may be of various geometries, so long as structural integrity of side plate 84, and therefore first auxiliary ejector 52, is not compromised, and may be thereby tailored for a target application. Ejector shoe 76 and ejector shoe 90 may contact primary ejector track 74 and auxiliary ejector track 88, respectively, such that refuse is guided out of primary ejector track 74 and auxiliary ejector track 88 to prevent undesirable refuse buildup. Refuse buildup within primary ejector track 74 and/or auxiliary ejector track 88 may result in damage to, and/or inefficient operation of, first primary ejector 48 and/or first auxiliary ejector 52.

As previously mentioned, first primary ejector 48 and first auxiliary ejector 52 may couple and decouple at certain points along their corresponding travels. According to an exemplary embodiment, one method of coupling and decoupling first primary ejector 48 and first auxiliary ejector 52 incorporates a mechanical locking mechanism included in first auxiliary ejector 52 which attaches to first primary ejector 48.

Figure 16:
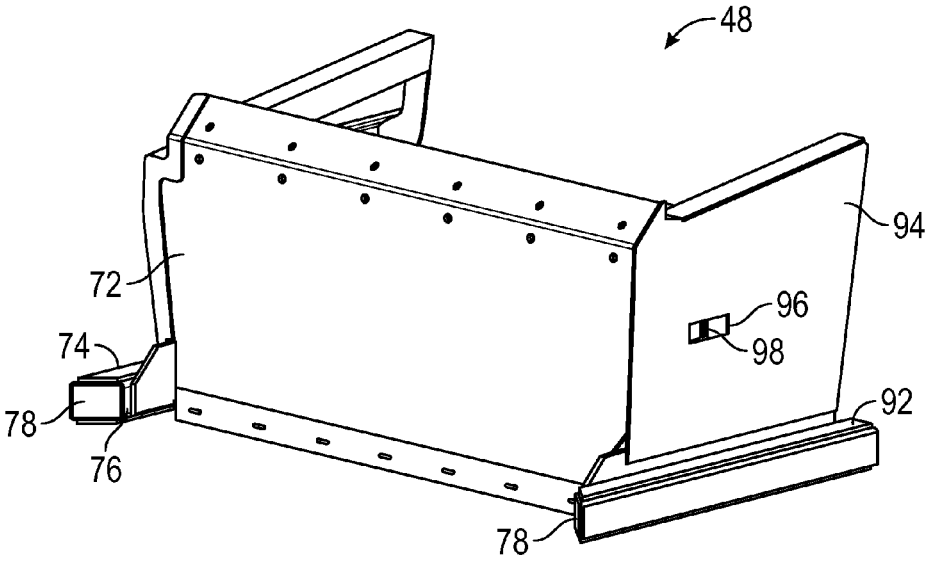
FIG. 16 is a perspective view of a primary ejector for a refuse vehicle, according to an exemplary embodiment of the present disclosure.

Referring to FIG. 16, first primary ejector 48 includes front plate 72, a side plate 94, a hole 96, a lock plate 98, and is mounted to primary ejector track 74 through the use of an ejector shoe 76 and a shoe stop plate 78. Hole 96 may be of various geometries, so long as structural integrity of side plate 94, and therefore first primary ejector 48, is not compromised, and may be thereby tailored for a target application. In some embodiments, Lock plate 98 is disposed inside first primary ejector 48 and mounted to side wall 94. Lock plate 98 may provide a locking surface through which first primary ejector 48 may be coupled to first auxiliary ejector 52. The location of hole 96 on side wall 94 may be adjusted to any location on side wall 94 to thereby be tailored for a specific application. In some embodiments, front plate 72 is configured to directly compact and eject refuse from refuse vehicle 10.

While front plate 72 is shown as being substantially flat and perpendicular to the ground in FIG. 16, it is understood that other geometries and orientations of front plate 72 are also possible. For example, front plate 72 may include a rounded lip disposed upon the rearward, relative to a primary direction of travel of refuse vehicle 10, edge in contact with body 14 such that a scraping mechanism is provided. Side wall 94 may interface with side plate 84 such that the gap between first primary ejector 48 and first auxiliary ejector 52 is substantially inconsequential when first primary ejector 48 is coupled to first auxiliary ejector 52. Minimizing the gap between first primary ejector 48 and first auxiliary ejector 52 may prevent refuse from being displaced in front, relative to a primary direction of travel of refuse vehicle 10, of first primary ejector 48 or first auxiliary ejector 52.

Figure 17:
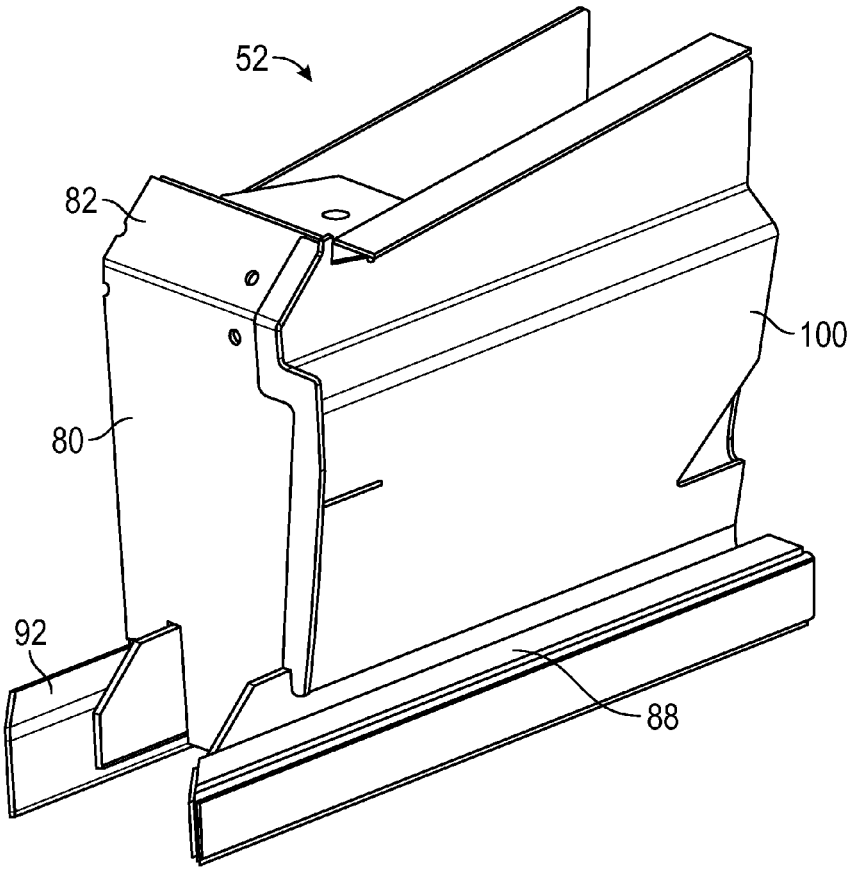
FIG. 17 is a perspective view of an auxiliary ejector for a refuse vehicle, according to an exemplary embodiment of the present disclosure.

Referring to FIG. 17, first auxiliary ejector 52 includes front plate 80, top plate 82, side plate 84, an outside plate 100, and is mounted to auxiliary ejector track 88, through the use of an ejector shoe 90 and a shoe stop plate 91. While front plate 80 is illustrated as substantially flat and perpendicular to the ground in FIG. 17, it is understood that other geometries and orientations of front plate 80 are also possible. For example, front plate 80 may include a rounded lip disposed upon the rearward, relative to a primary direction of travel of refuse vehicle 10, edge in contact with body 14 such that a scraping mechanism is provided. Outside plate 100 may interface with side body 14 such that the gap between first auxiliary ejector 52 and body 14 is substantially inconsequential. Reducing the gap between first auxiliary ejector 52 and body 14 prevents refuse from being displaced in front, relative to a primary direction of travel of refuse vehicle 10, of first auxiliary ejector 52 or between first auxiliary ejector 52 and body 14.

Figure 18:
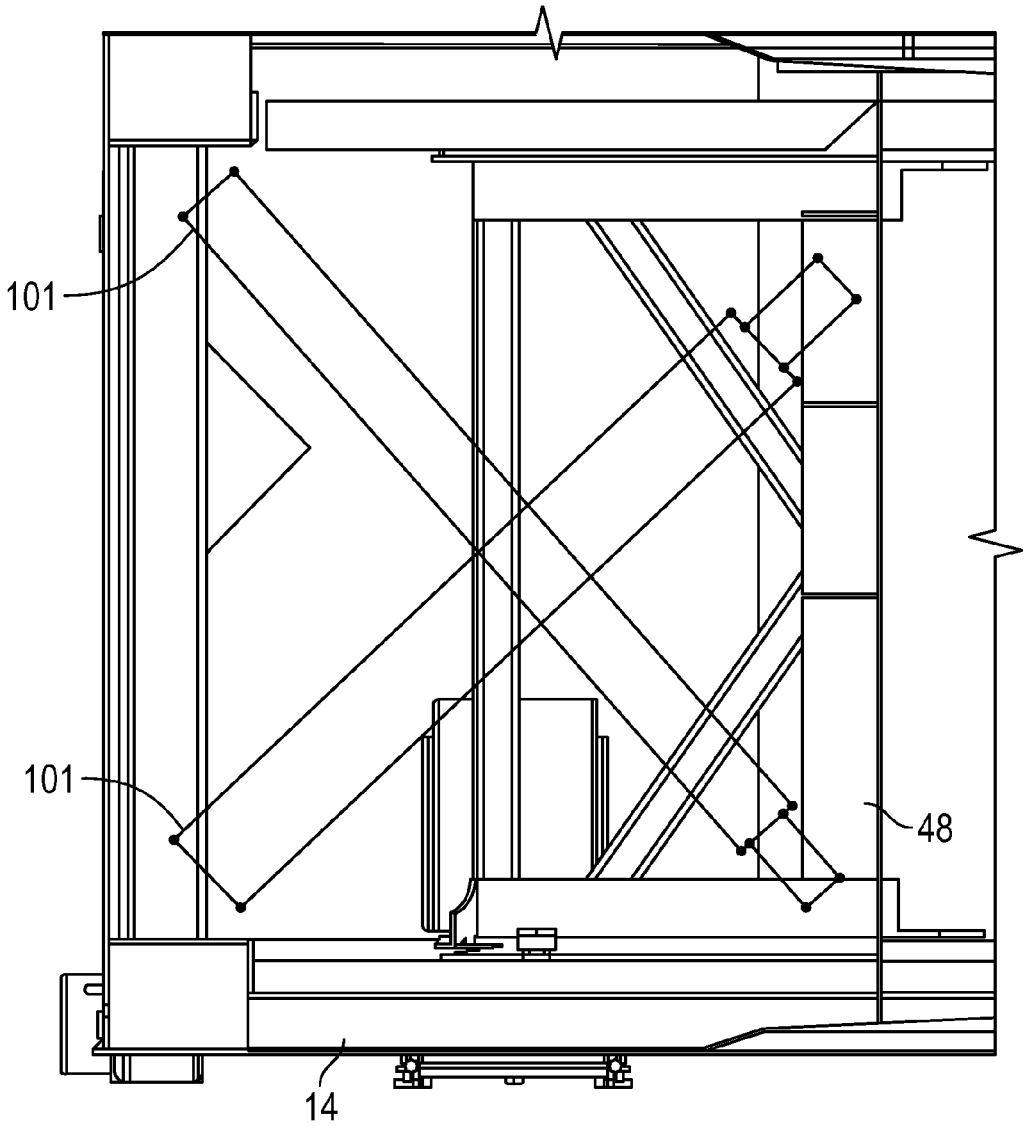
FIG. 18 is a cross-sectional view of a body and a primary ejector for a refuse vehicle, according to an exemplary embodiment of the present disclosure.

Referring to FIG. 18, a cross-sectional view of first primary ejector 48 contained within body 14 of refuse vehicle 10 is shown. According to an exemplary embodiment, first primary ejector 48 includes a number of movement devices, shown as actuators 101, configured to translate first primary ejector 48 within body 14 of refuse vehicle 10. Actuator 101 may be a pneumatic cylinder, hydraulic cylinder, linear actuator, a gear and chain, interlocking track, or other movement device, and may be thereby tailored for a target application. Alternatively, actuator 101 may be a gear train, a rack and pinion mechanism, or other mechanical, electromechanical, or magnetic mechanism, and may be thereby tailored for a target application. First primary ejector 48 may include any number of actuators 101 disposed at differing angles and thereby tailored for a target application. According to an exemplary embodiment, first primary ejector 48 includes two actuators 101 substantially disposed in a crossed position. Actuator 101 may be rotatably connected to body 14 and/or first primary ejector 48 through the use of flanges (e.g., hinges, etc.). According to an exemplary embodiment, first primary ejector 48 includes one actuator 101. However, first primary ejector 48 may include three, four, five, or more actuators 101.

Figure 19:
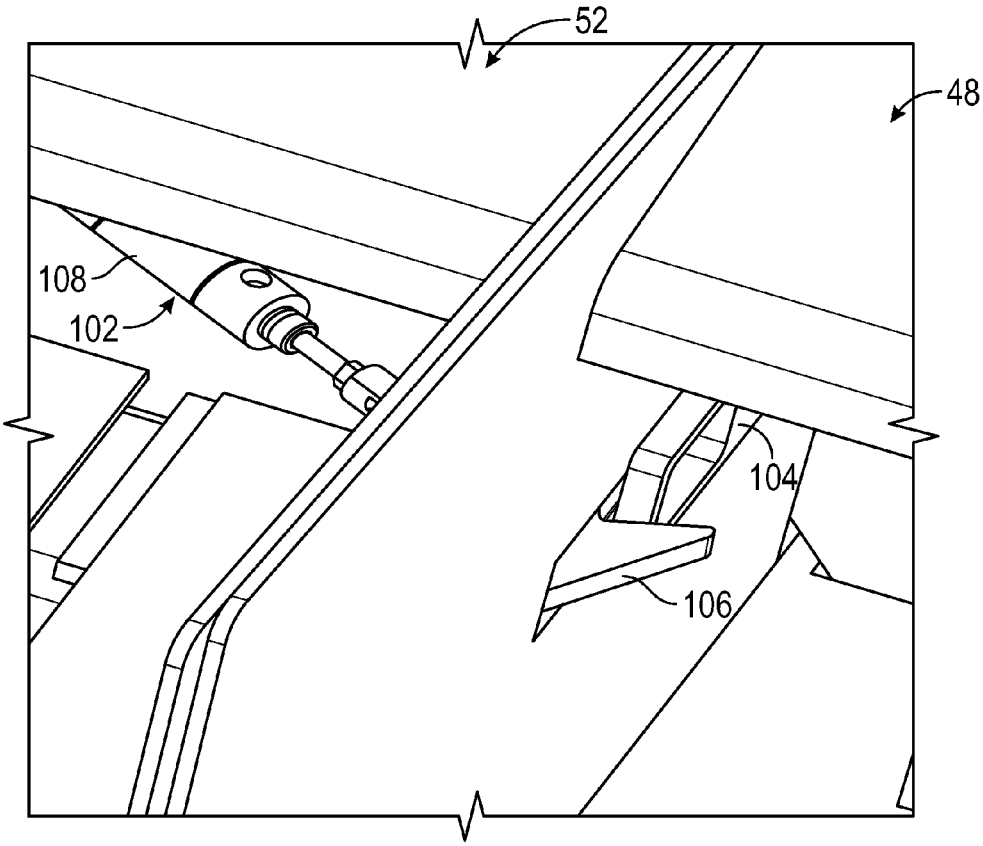
FIG. 19 is a perspective view of a locking mechanism for selectively coupling an auxiliary ejector and a primary ejector of a refuse vehicle, according to an exemplary embodiment of the present disclosure.
Figure 20:
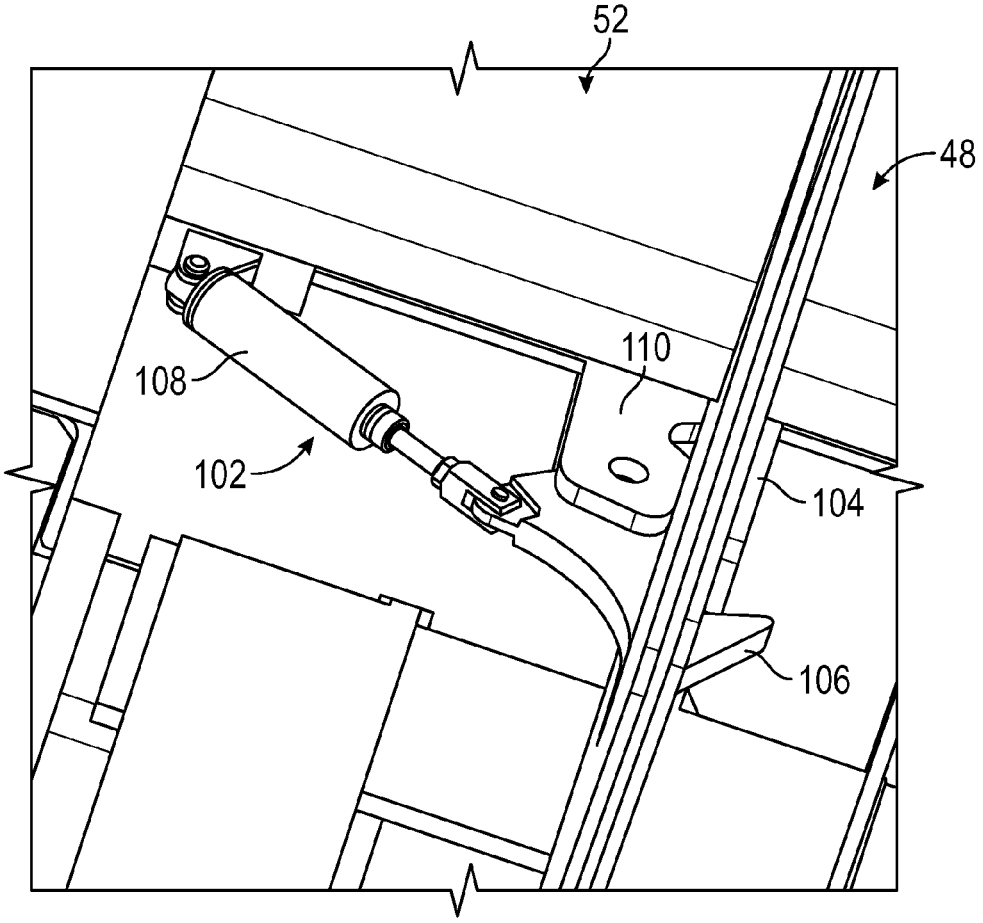
FIG. 20 is a perspective view of the locking mechanism shown in FIG. 22, according to an exemplary embodiment of the present disclosure.
Figure 21:
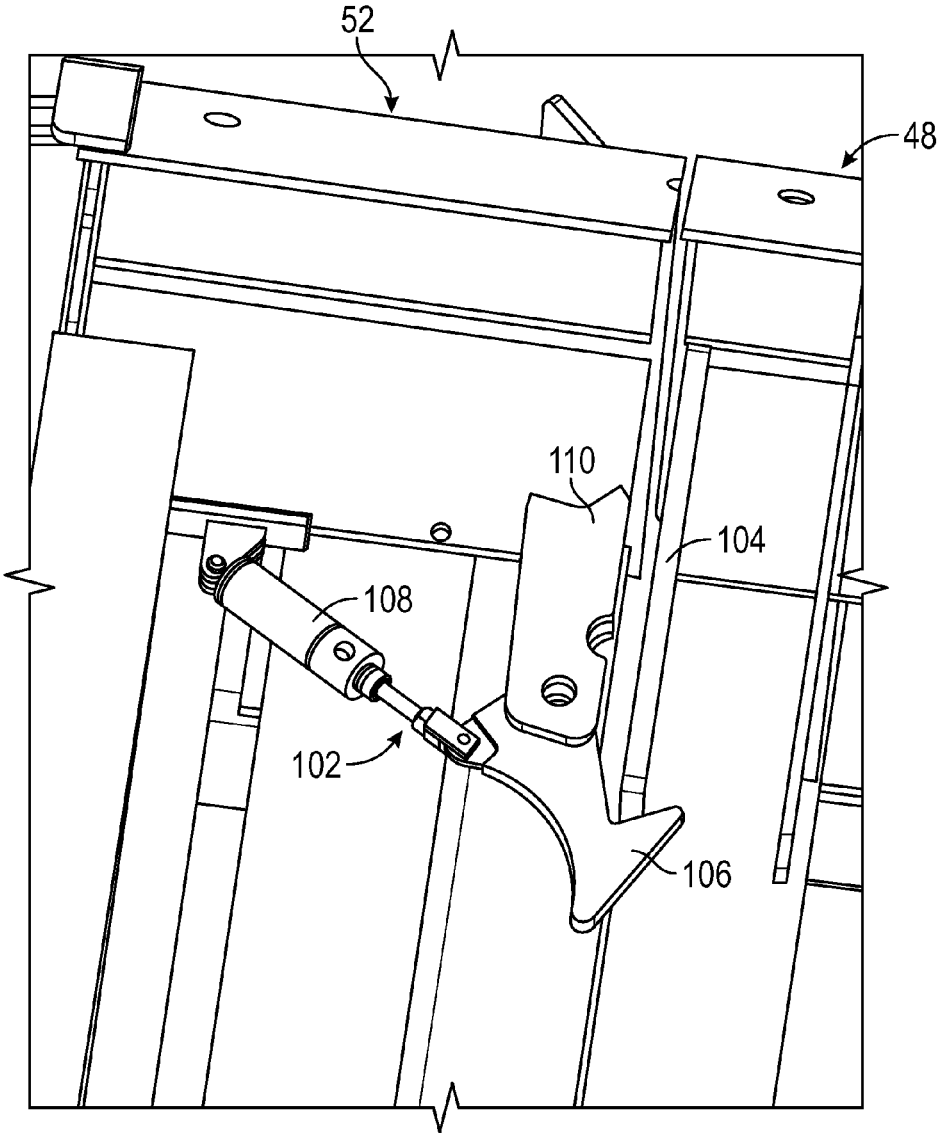
FIG. 21 is a perspective view of the locking mechanism shown in FIG. 22, according to an exemplary embodiment of the present disclosure.

Referring to FIGS. 19-21, a locking mechanism, shown as pickup 102, couples first auxiliary ejector 52 to first primary ejector 48. Pickup 102 includes a plate, shown as locking plate 104, a shaped plate, shown as catch 106, and a movement device, shown as actuator 108. Catch 106 and locking plate 104 may be various materials and geometries and may be thereby tailored for a target application. Actuator 108 may be any movement device (e.g., pneumatic cylinder, hydraulic cylinder, etc.) and may be thereby tailored for a target application. Alternatively, actuator 108 may be a gear train, a rack and pinion mechanism, or other mechanical, electromechanical, or magnetic mechanism, and may be thereby tailored for a target application.

Actuator 108 may be rotatably connected to first auxiliary ejector 52 and/or first primary ejector 48 through the use of appropriate flanges (e.g., hinges, etc.). According to an exemplary embodiment, pickup 102 is configured such that catch 106 is attached (e.g., through locking threads, nut and bolt, rivet, weld, etc.) to actuator 108, and engages locking plate 104. Actuator 108, and therefore catch 106, may be attached to first auxiliary ejector 52 (e.g., through locking threads, nut and bolt, rivet, weld, etc.) and locking plate 104 may be attached to first primary ejector 48 (i.e., through locking threads, nut and bolt, rivet, weld, etc.). Movement of first primary ejector 48 may be coupled to movement of first auxiliary ejector 52 through the interface of catch 106 through hole 86 and hole 96, and locking plate 104. According to other exemplary embodiments, actuator 108, and therefore catch 106, is attached to first primary ejector 48 (i.e., through locking threads, nut and bolt, rivet, weld, etc.) and lock plate 104 is attached to first auxiliary ejector 52 (i.e., through locking threads, nut and bolt, rivet, weld, etc.).

Pickup 102 may couple first auxiliary ejector 52 to first primary ejector 48, or first primary ejector 48 to first auxiliary ejector 52, through the use of various sensing mechanisms or mechanical configurations. For example, first auxiliary ejector 52 and first primary ejector 48 may each individually contain sensors, switches, or other sensing mechanisms (e.g., mechanical, electromechanical, hall effect, magnetic, etc.) configured operate independently or dependently to provide a signal to pickup 102 at a desired point in time. According to an exemplary embodiment, pickup 102 couples and decouples the movement of first primary ejector 48 to the movement of first auxiliary ejector 52 when first primary ejector 48 reaches mid post 56 or a target point associated with mid post 56. However, other target points along the travel of first primary ejector 48 may be configured to instruct pickup 102 to couple and/or decouple the movement of first primary ejector 48 to first auxiliary ejector 52. Pickup 102 may couple and/or decouple first auxiliary ejector 52 to first primary ejector 48 through the use of an unloader valve, proximity sensor, cam actuated valve, switch, or other unloading mechanism, and may be thereby tailored for a target application. Pickup 102 may also couple first auxiliary ejector 52 to first primary ejector 48 through the use of a spring-loading mechanism included within pickup 102. According to this embodiment, pickup 102 would automatically couple first auxiliary ejector 52 to first primary ejector 48 at a target point where catch 106 engages locking plate 104.

Referring specifically to FIG. 20, pickup 102 includes a support plate 110 attached to catch 106. According to an exemplary embodiment, support plate 110 is attached to first auxiliary ejector 52 provides a base of rotation and structural support for catch 106. According to other exemplary embodiments, support plate 110 is attached to first primary ejector 48. In some embodiments, pickup 102 does not include support plate 110. In other embodiments, support plate 110 is integrally formed within first auxiliary ejector 52 or first primary ejector 48.

Referring specifically to FIG. 21, catch 106 has a substantially flat surface to engage with a corresponding surface of locking plate 104. According to an exemplary embodiment, locking plate 104 provides a structural base for interfacing with catch 106. According to various embodiments, different configurations interfaces between catch 106 and locking plate 104 are possible. For example, a magnetic, structurally interlocking (i.e., through the use of a chain and gear or similar), or ball and socket interface may exist between catch 106 and locking plate 104.

As a result of utilizing pickup 102 to couple first auxiliary ejector 52 to first primary ejector 48, hole 86 and hole 96, in addition to the interfaces between body 14, first primary ejector 48, and first auxiliary ejector 52, provide entrances for refuse to unintentionally collect during operation resulting in refuse buildup. Over time, refuse buildup in these locations may necessitate maintenance or cleaning. Additionally, refuse buildup may cause actuator 101 to provide additional power to manipulate first auxiliary ejector 52 and to use first auxiliary ejector 52 to eject and/or compact refuse which may result in damage or failure of actuators 101. Accordingly, other methods and mechanisms for coupling first auxiliary ejector 52 to first primary ejector 48 may be employed.

Figure 22:
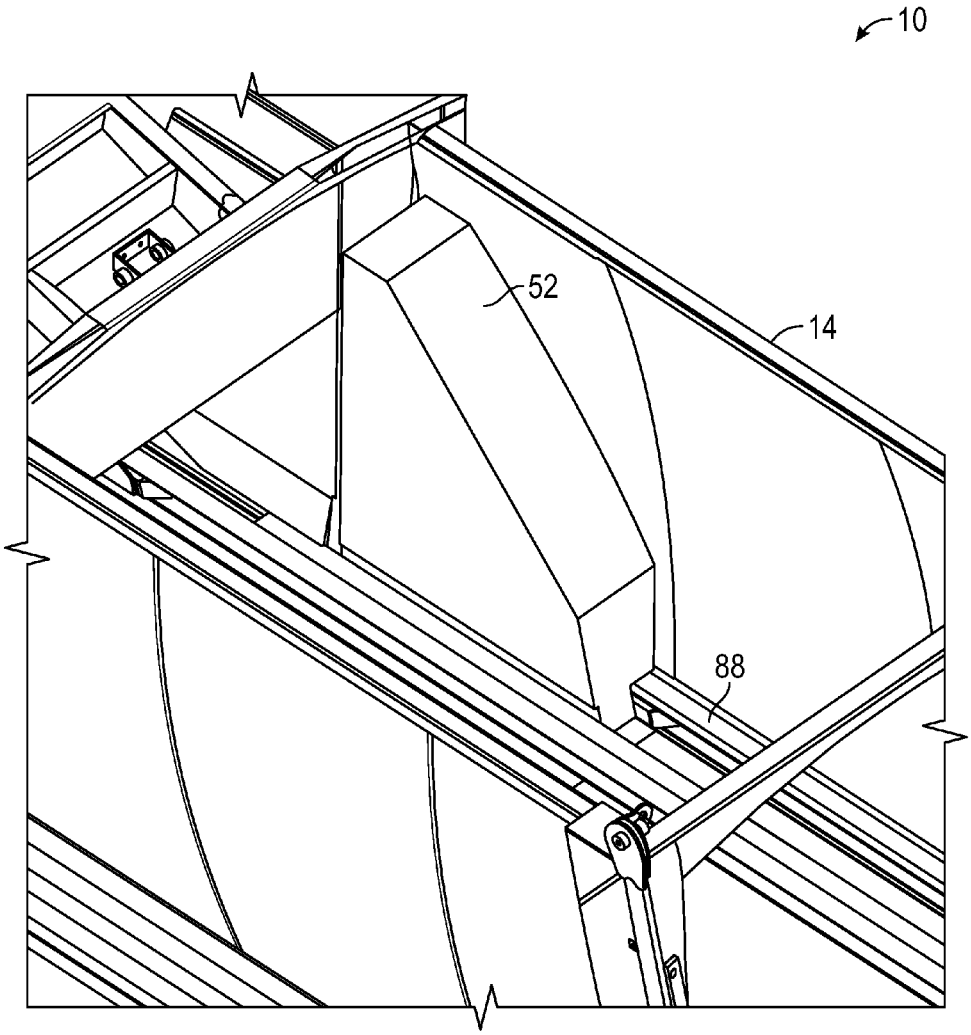
FIG. 22 is a top perspective view of the body shown in FIGS. 4-5, according to an exemplary embodiment of the present disclosure.
Figure 23:
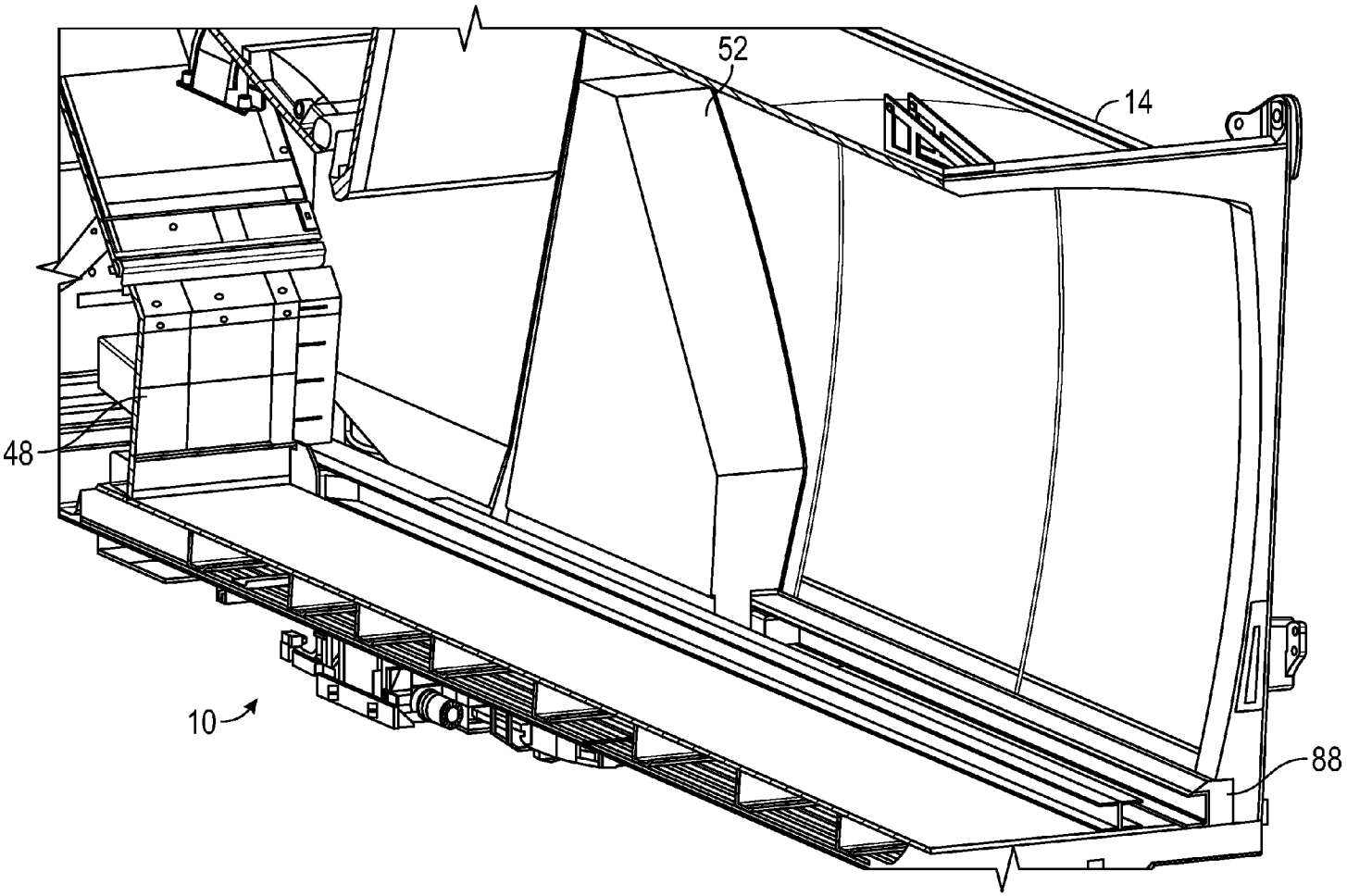
FIG. 23 is a cross-sectional view of the body shown in FIG. 15, according to an exemplary embodiment of the present disclosure.
Figure 24:
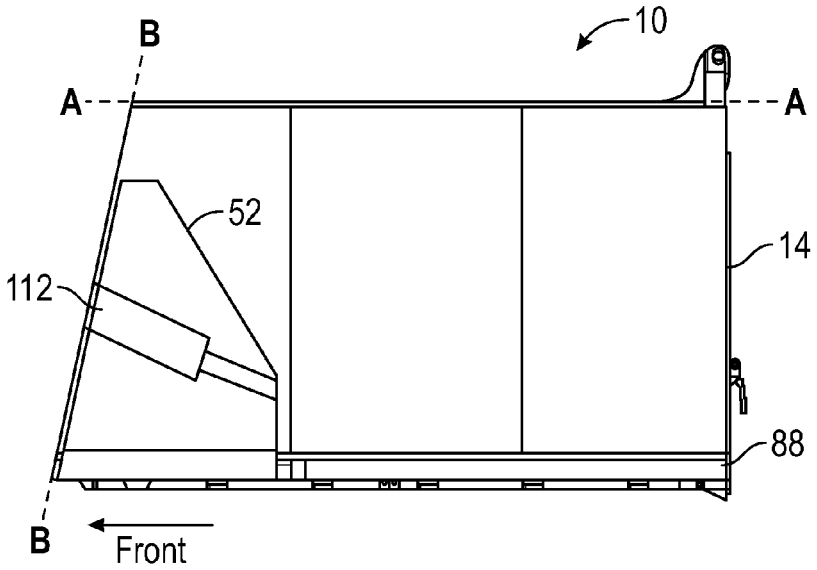
FIG. 24 is a cross-sectional view of the body shown in FIG. 5, according to an exemplary embodiment of the present disclosure.

Referring to FIGS. 22-24, first auxiliary ejector 52 includes a movement device, shown as actuator 112, configured to translate first auxiliary ejector 52 along auxiliary ejector track 88. Actuator 112 may be a pneumatic cylinder, hydraulic cylinder, linear actuator, a gear and chain, interlocking track, or other movement device, and may be thereby tailored for a target application. Alternatively, actuator 112 may be a gear train, a rack and pinion mechanism, or other mechanical, electromechanical, or magnetic mechanism, and may be thereby tailored for a target application. Actuator 112 may be rotatably connected to body 14 and/or first auxiliary ejector 52 through the use of appropriate flanges (e.g., hinges, etc.) According to an exemplary embodiment, refuse vehicle 10 utilizes actuator 112 rather than pickup 102 to couple movement of first auxiliary ejector 52 with movement of first primary ejector 48. In some embodiments, refuse vehicle 10 utilizes pickup 102 and actuator 112 to couple movement of first auxiliary ejector 52 with movement of first primary ejector 48. In other embodiments, first auxiliary ejector 52 and first primary ejector 48 each individually contain sensors, switches, or other sensing mechanisms (e.g., mechanical, electromechanical, hall effect, magnetic, etc.) configured operate independently or dependently to provide a signal to actuator 112 at a target point. Referring specifically to FIG. 24, a cross sectional view of first auxiliary ejector 52 within body 14 of refuse vehicle 10 shown in FIG. 5 is illustrated. Actuator 112 may be mounted at any height or any angle from body 14 to first auxiliary ejector 52 and may be thereby tailored for a target application. By utilizing actuator 112, there may be no holes in first primary ejector 48 or first auxiliary ejector 52. This may prevent the refuse buildup that may be experienced through the use of pickup 120, hole 86, and hole 96.

Figure 25:
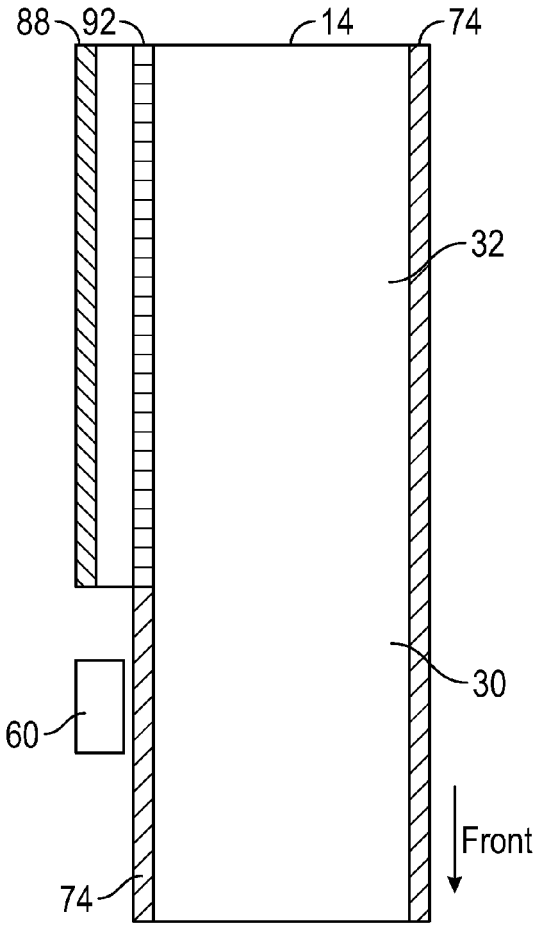
FIG. 25 is a schematic view of a primary ejector track for a primary ejector and an auxiliary ejector track for an auxiliary ejector, according to an exemplary embodiment of the present disclosure.

Referring to FIGS. 25-28, various illustrations of primary ejector track 74 and auxiliary ejector track 88 are shown. As shown in FIG. 25, primary ejector track 74 is disposed on one lateral side of body 14 while auxiliary ejector track 88 is disposed on another lateral side of body 14. The length of primary ejector track 74 defines the travel for first primary ejector 48 within body 14 while the length of auxiliary ejector track 88 defines the travel for first auxiliary ejector 52 within body 14. Primary ejector track 74 may be of any configuration to engage with ejector shoe 76 such as a channel track, a rack and pinion mechanism, a magnetic track, and other track configurations, and may be thereby tailored for a target application. According to an exemplary embodiment, common body 92 contains both primary ejector track 74 and auxiliary ejector track 88.

Figure 26:
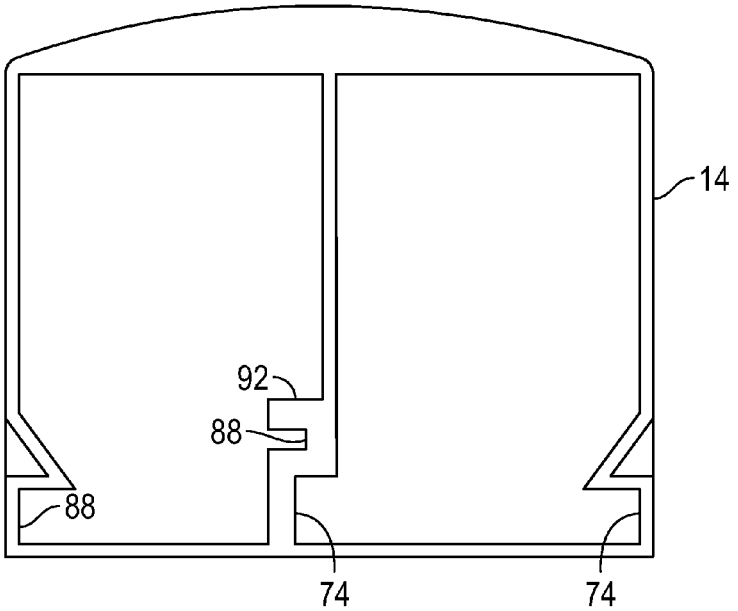
FIG. 26 is a front view of a cross-section of the body shown in FIGS. 4-5, according to an exemplary embodiment of the present disclosure.
Figure 27:
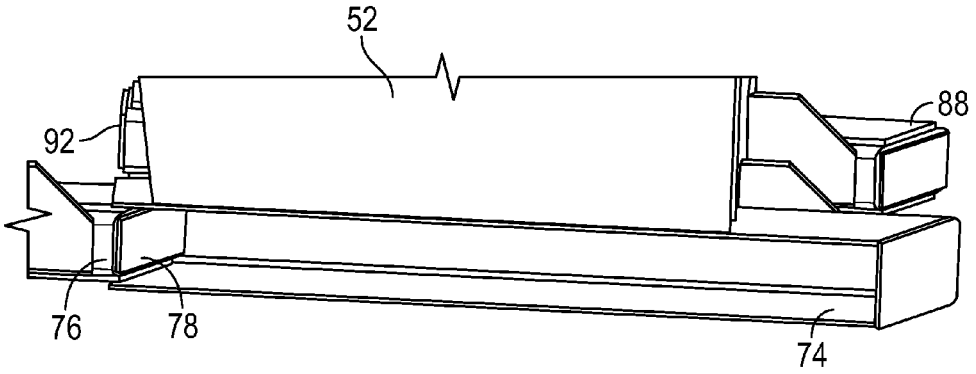
FIG. 27 is a perspective view of a common track body including a primary ejector track for a primary ejector and an auxiliary ejector track for an auxiliary ejector, according to an exemplary embodiment of the present disclosure.
Figure 28:
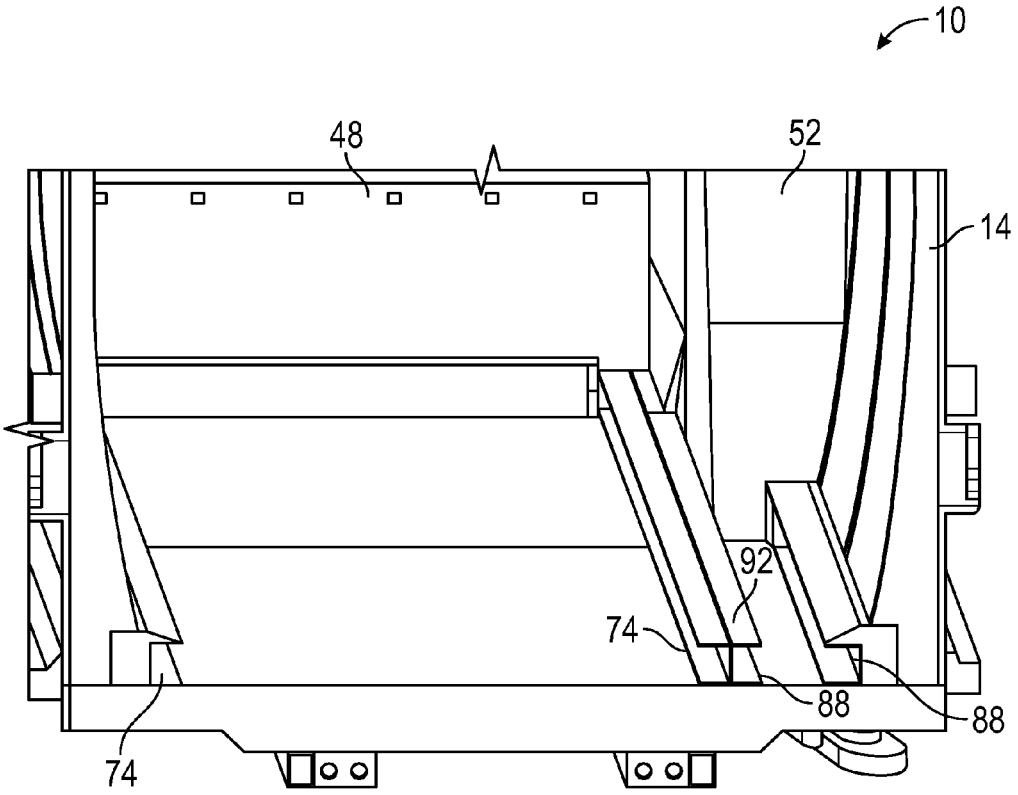
FIG. 28 is a perspective view of the body shown in FIGS. 4-5, according to an exemplary embodiment of the present disclosure.

Referring to FIGS. 26 and 27, common body 92 includes primary ejector track 74 disposed above, relative to the ground, auxiliary ejector track 88. According to various exemplary embodiments, common body 92 includes primary ejector track 74 disposed below auxiliary ejector track 88. In other embodiments, common body 92 includes primary ejector track 74 disposed vertically and/or laterally offset from auxiliary ejector track 88, and may thereby be tailored for a target application. Referring to FIG. 28, common body 92 includes primary ejector track 74 disposed laterally offset from auxiliary ejector track 88. According to various embodiments, common body 92 is welded to body 14. In other embodiments, common body 92 may be bolted, secured, fastened, or otherwise attached to body 14 of refuse vehicle 10.

Figure 29:
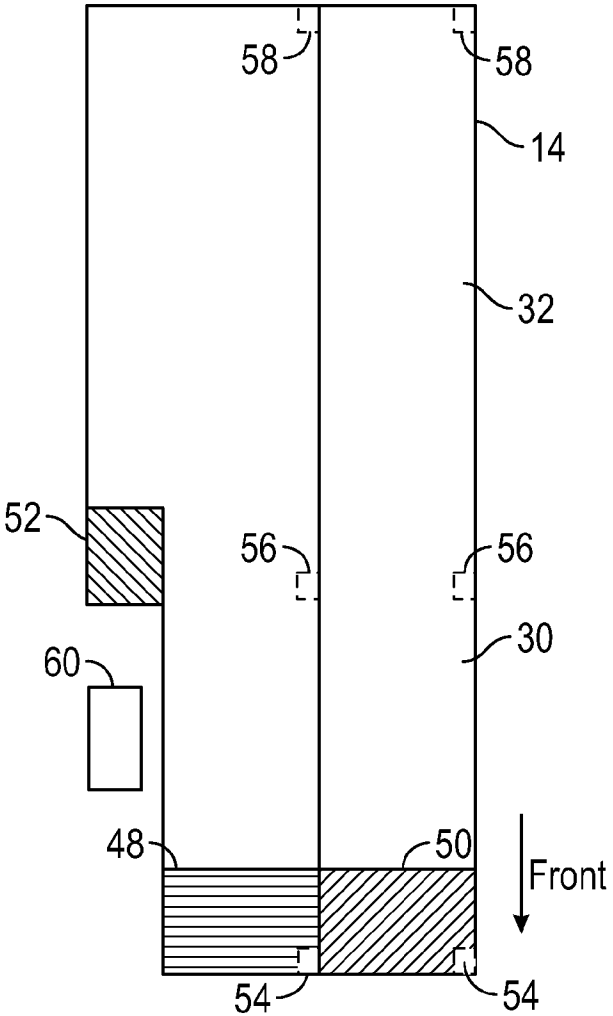
FIG. 29 is a schematic view of a first primary ejector, a second primary ejector, and an auxiliary ejector mounted within a body of a side-loading refuse vehicle having a container handling system disposed on one side of the body, according to an exemplary embodiment of the present disclosure.

Referring to FIG. 29, refuse vehicle 10 includes container handling system 60 and first primary ejector 48, second primary ejector 50, and first auxiliary ejector 52 contained within body 14. As shown in FIG. 29, refuse may be compacted and ejected within two sections of body 14, such as is done with multi-stream refuse vehicles. FIG. 29 illustrates body 14 having an asymmetrical shape. Accordingly, first auxiliary ejector 52 has been incorporated in refuse vehicle 10 to cooperate with first primary ejector 48 to provide complete compacting and ejecting ability for the other section of body 14 of refuse vehicle 10. As previously discussed, primary ejector operates from front post 54 to mid post 56, couples to first auxiliary ejector 52, and both first primary ejector 48 and first auxiliary ejector 52 travel to rear post 58.

Figure 30:
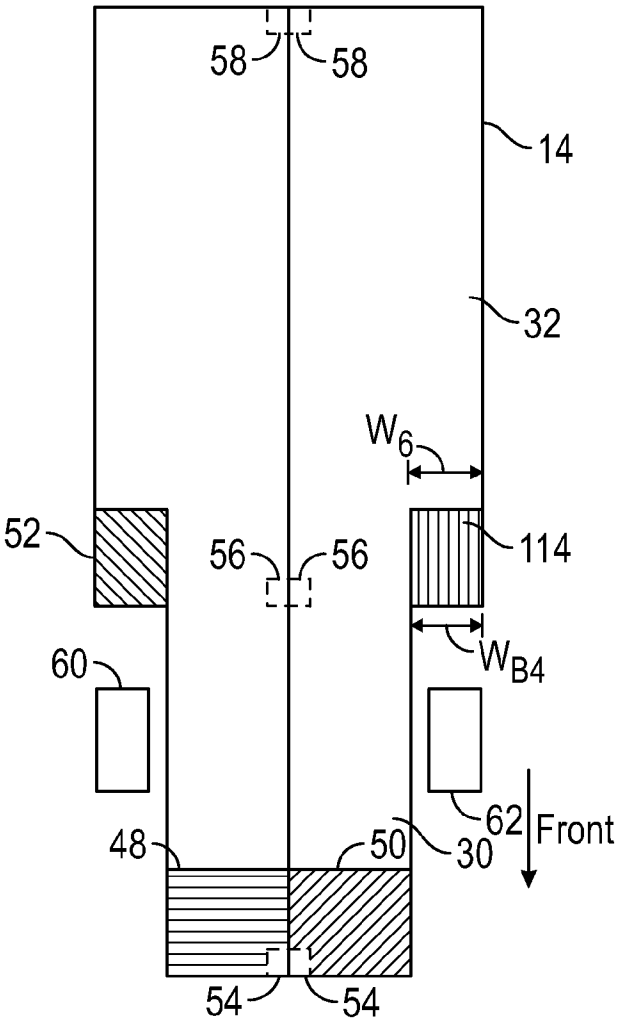
FIG. 30 is a schematic view of a first primary ejector, a second primary ejector, a first auxiliary ejector, and a second auxiliary ejector mounted within a body of a side-loading refuse vehicle having container handling systems disposed on either side of the body, according to an exemplary embodiment of the present disclosure.

Referring to FIG. 30, refuse vehicle 10 includes container handling system 60, container handling system 62, and first primary ejector 48, second primary ejector 50, first auxiliary ejector 52, and a fourth packer mover (e.g., ram, pusher, etc.), shown as second auxiliary ejector 114, within body 14. Second auxiliary ejector 114 may be an actuator (e.g., hydraulic cylinder, pneumatic cylinder, etc.). According to the exemplary embodiment shown in FIG. 30, body 14 is substantially symmetrical along only one axis. In some embodiments, the use of multiple container handling systems may be advantageous to the operation of refuse vehicle 10. For instance, in a narrow alleyway (e.g., alley, road, street, path, etc.) refuse vehicle 10 may include container handling system 60 disposed on one side of refuse vehicle 10 and second container handling system 62 disposed on the opposite side of refuse vehicle 10, in order to efficiently collect multiple refuse containers in one stop. Alternatively, such a configuration would allow refuse vehicle 10 to collect refuse containers from opposite sides of the alleyway without turning around and going back down the alleyway.

As shown in FIG. 30, refuse may be compacted and ejected within two sections of body 14, such as is done with multi-stream refuse vehicles. As a result, each section may accommodate one of, or a combination of, organics, recycling, and other refuse. Accordingly, second auxiliary ejector 114 has been incorporated to cooperate with second primary ejector 50 to provide complete compacting and ejecting ability for one section of body 14 of refuse vehicle 10. According to an exemplary embodiment, second primary ejector 50 operates from front post 54 to mid post 56, couples to second auxiliary ejector 114, and both second primary ejector 50 and second auxiliary ejector 114 travel (e.g., move, etc.) to rear post 58. According to an exemplary embodiment, first auxiliary ejector 52 is incorporated within refuse vehicle 10 to cooperate with first primary ejector 48 to provide complete compacting and ejecting ability for a section of body 14 of refuse vehicle 10. As previously discussed, primary ejector operates from front post 54 to mid post 56, couples to first auxiliary ejector 52, and both first primary ejector 48 and first auxiliary ejector 52 travel (e.g., move, etc.) to rear post 58. Second auxiliary ejector 114 may include a pickup or an actuator in order to facilitate translation through body 14 of refuse vehicle 10. Similarly, second auxiliary ejector 114 may be translated by a gear train, a rack and pinion mechanism, or other mechanical, electromechanical, or magnetic mechanism, and may be thereby tailored for a target application.

According to an exemplary embodiment, the width, $W_6$, of second auxiliary ejector 114 is narrower than the width, $W_{B4}$, of one section of body 14 by a spacing distance. This spacing distance may facilitate the operation of second auxiliary ejector 114 and accommodate clearances, hardware interfaces, and/or other dimensional constraints. According to an exemplary embodiment, the difference between the width, $W_6$, of second auxiliary ejector 114 and the width, $W_{B4}$, of one section of body 14 is such that refuse is substantially confined to the area defined by the rearward face, in relation to a primary direction of travel of refuse vehicle 10, of second auxiliary ejector 114 and one section of body 14.

Figure 31:
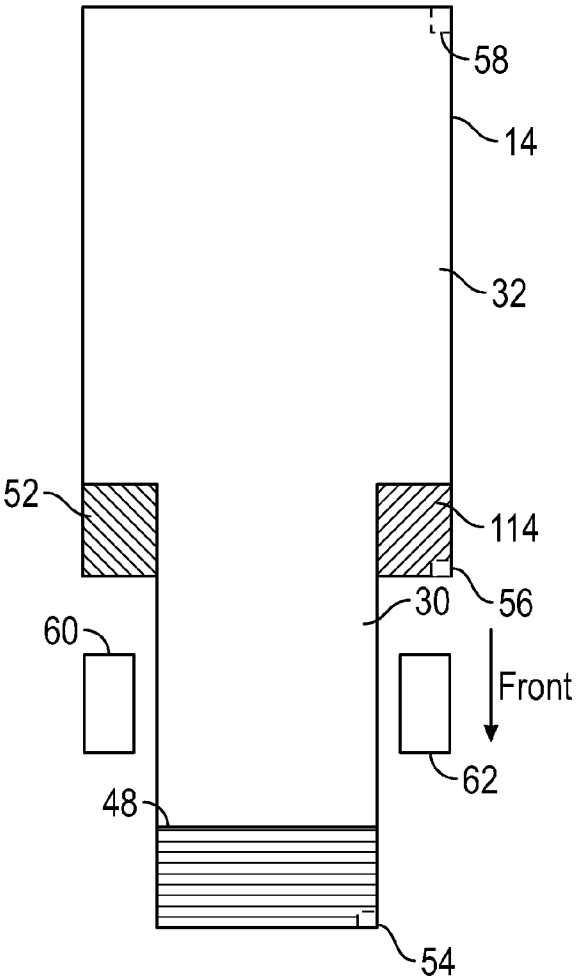
FIG. 31 is a schematic view of a primary ejector, a first auxiliary ejector, and a second auxiliary ejector mounted within a body of a side-loading refuse vehicle having container handling systems disposed on either side of the body, according to an exemplary embodiment of the present disclosure.

Referring to FIG. 31, refuse vehicle 10 includes container handling system 60, container handling system 62, and first primary ejector 48, first auxiliary ejector 52, and second auxiliary ejector 114, within body 14. Body 14 may be substantially symmetrical along only one axis. As shown in FIG. 31, refuse truck has only one section (i.e., for refuse, recycling, organics, etc.) which may be fully compacted and ejected by first primary ejector 48, first auxiliary ejector 52, and second auxiliary ejector 114. Second auxiliary ejector 114 has been incorporated to cooperate with first primary ejector 48 to provide complete compacting and ejecting ability for body 14 of refuse vehicle 10. According to an exemplary embodiment, first primary ejector 48 operates from front post 54 to mid post 56, couples to second auxiliary ejector 114 and first auxiliary ejector 52, after which first primary ejector 48, first auxiliary ejector 52, and second auxiliary ejector 114 travel to rear post 58. Second auxiliary ejector 114 and first auxiliary ejector 52 may include a pickup or an actuator in order to facilitate translation through body 14 of refuse vehicle 10. Similarly, second auxiliary ejector 114 may be translated by a gear train, a rack and pinion mechanism, or other mechanical, electromechanical, or magnetic mechanism, and may be thereby tailored for a target application.

Through the use of first primary ejector 48, second primary ejector 50, first auxiliary ejector 52, and/or second auxiliary ejector 114, refuse vehicle 10 may maintain a maximum overall width of less than one-hundred and two inches during operation while maintaining the ability to fully compact refuse within, and/or eject refuse from, refuse vehicle 10. Through the use of first primary ejector 48, second primary ejector 50, first auxiliary ejector 52, and/or second auxiliary ejector 114, refuse vehicle 10 may be a full-eject refuse vehicle, meaning that it is not necessary to raise body 14 of refuse vehicle 10 to empty refuse from refuse vehicle 10.

Referring to FIGS. 32-38, control diagrams for refuse vehicle 10 are shown. It is understood that various configurations and permutations of the control diagrams described in the present application and FIGS. 32-38 are possible and that no single permutation departs from the spirit of the present application. According to various exemplary embodiments, refuse vehicle 10 includes a processing circuit 116, a user interface 118, and an ejector controller 120. Ejector controller 120 may include processing circuit 116 which may further include a processor 122 and a memory 124. According to various exemplary embodiments, user interface 118 serves as a general input/output device between an operator and refuse vehicle 10. According to various embodiments, ejector controller 120 receives signals from ejector controller 120, which may receive signals from user interface 118, and routes them to a combination of first primary ejector 48, second primary ejector 50, first auxiliary ejector 52, and/or second auxiliary ejector 114. Memory 124 may include various target points to define the motion (e.g., travel, movement, etc.) of first primary ejector 48, second primary ejector 50, first auxiliary ejector 52, and/or second auxiliary ejector 114.

Figure 32:
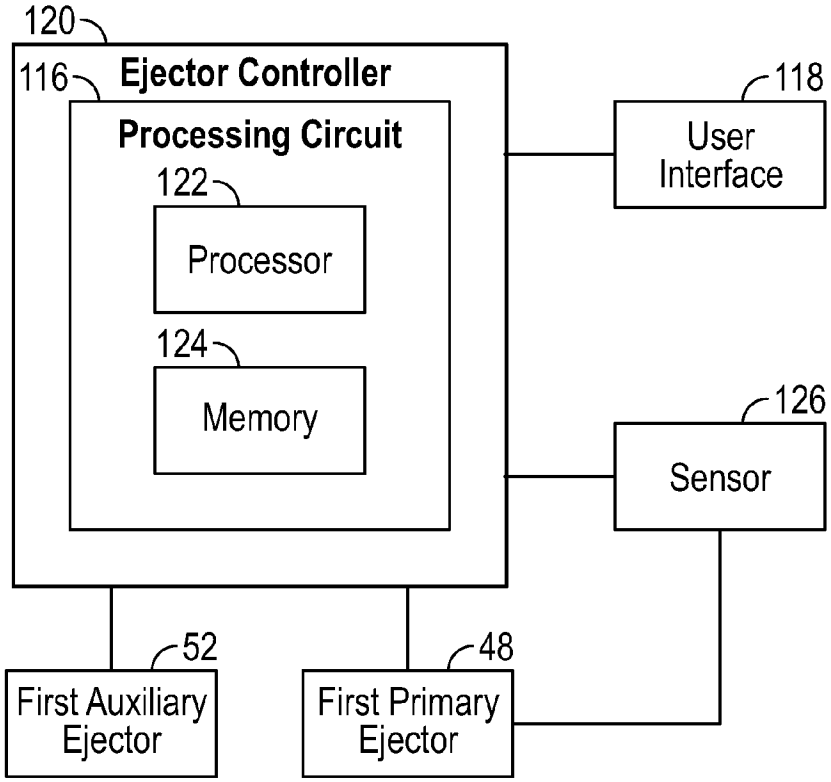
FIG. 32 is a control diagram for a primary ejector and an auxiliary ejector of a refuse vehicle, according to an exemplary embodiment of the present disclosure.

As shown in FIG. 32, refuse vehicle 10 includes a sensor 126. Sensor 126 may be a location identifying device, such as a radio-frequency identification chip or tag, a hall-effect sensor, a proximity sensor, a mechanical, electrical, or electromechanical switch, or other location identifying device, and may be thereby tailored for a target application. According to an exemplary embodiment, sensor 126 is configured to relay the position, or other parameter, of first primary ejector 48 to ejector controller 120 which will determine the proper course of action with respect to first auxiliary ejector 52, and may be thereby tailored for a target application. Processing circuit 116 may compute various outputs of ejector controller 120 given inputs obtained from sensor 126. For example, if first primary ejector 48 is forward, relative to a primary direction of travel of refuse vehicle 10, of mid post 56, ejector controller 120 may ensure that first auxiliary ejector 52 is at its initial position. However, if first primary ejector 48 is at mid post 56, ejector controller 120 may couple first auxiliary ejector 52 to first primary ejector 48 using pickup 102, or may instruct actuator 112 to begin to translate first auxiliary ejector 52.

Figure 33:
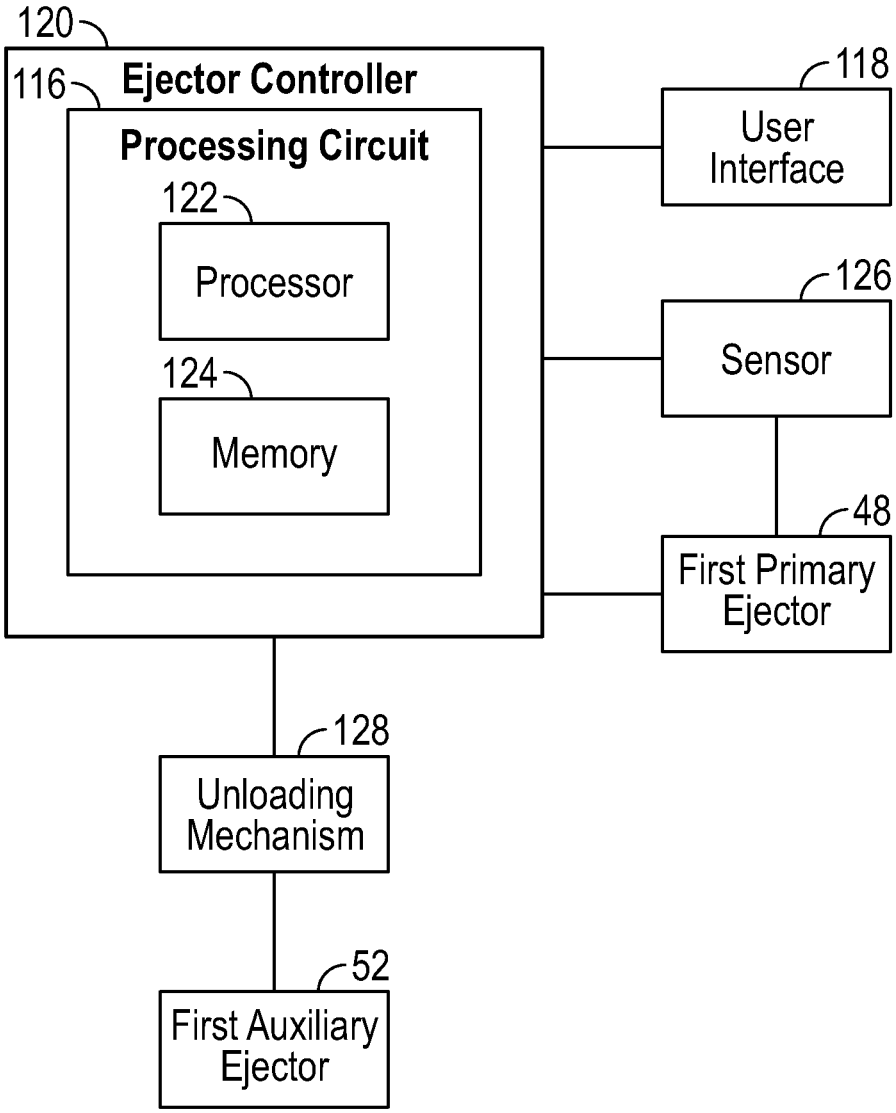
FIG. 33 is a control diagram for a primary ejector and an auxiliary ejector of a refuse vehicle, according to an exemplary embodiment of the present disclosure.
Figure 34:
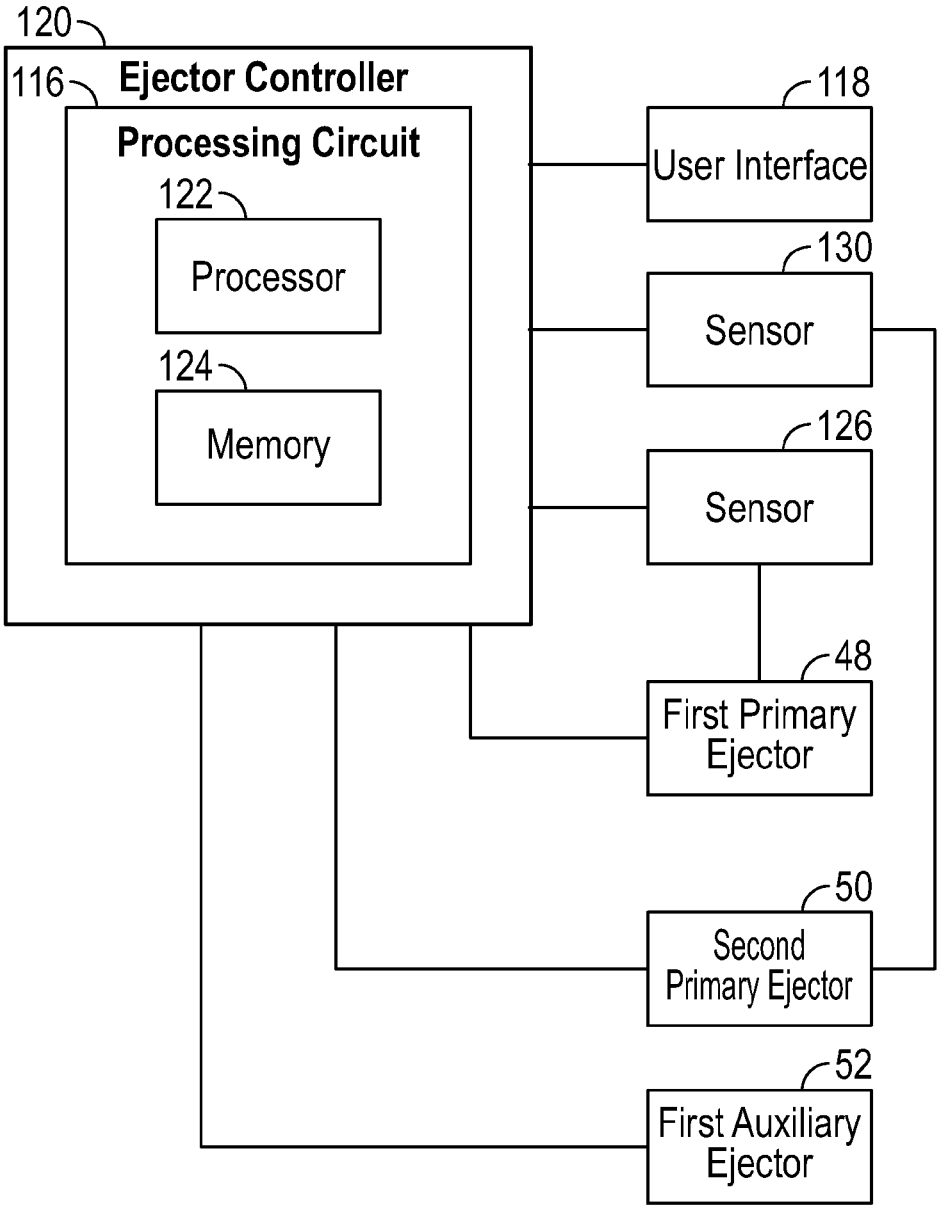
FIG. 34 is a control diagram for a first primary ejector, a second primary ejector, and an auxiliary ejector, according to an exemplary embodiment of the present disclosure.
Figure 35:
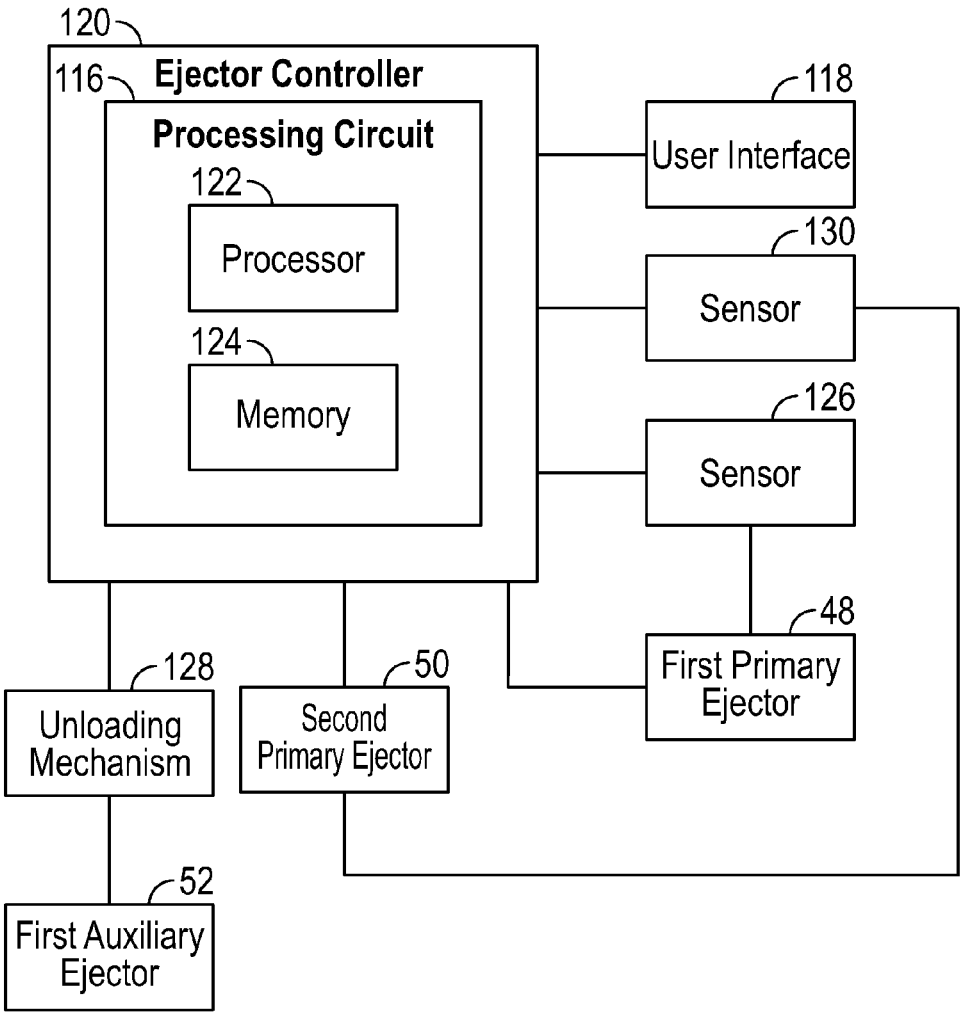
FIG. 35 is a control diagram for a first primary ejector, a second primary ejector, and an auxiliary ejector, according to an exemplary embodiment of the present disclosure.

Referring to FIG. 33, refuse vehicle 10 may further include unloading mechanism 128. Unloading mechanism 128 may be an unloader valve, proximity sensor, cam actuated valve, switch, or other unloading mechanism, and may be thereby tailored for a target application. Memory 124 may include various information on unloading mechanism 128 including target points and actuation duration (i.e., the amount of time unloading mechanism 128 takes to actuate, etc.). Unloading mechanism 128 may receive signals from ejector controller 120 to instruct unloading mechanism 128 to decouple first auxiliary ejector 52 from first primary ejector 48. Referring to FIG. 34, refuse vehicle 10 may further include a second sensor 130 configured to communicate with second primary ejector 50 and ejector controller 120. According to an exemplary embodiment, sensor 130 is configured to relay the position, or other parameter, of second primary ejector 50 to ejector controller 120, and may be thereby tailored for a target application. Sensor 130 may be a location identifying device, such as a radio-frequency identification chip or tag, a hall-effect sensor, a proximity sensor, a mechanical, electrical, or electromechanical switch, or other location identifying device, and may be thereby tailored for a target application. Processing circuit 116 may compute various outputs of ejector controller 120 given inputs obtained from sensor 126 and/or sensor 130.

Figure 36:
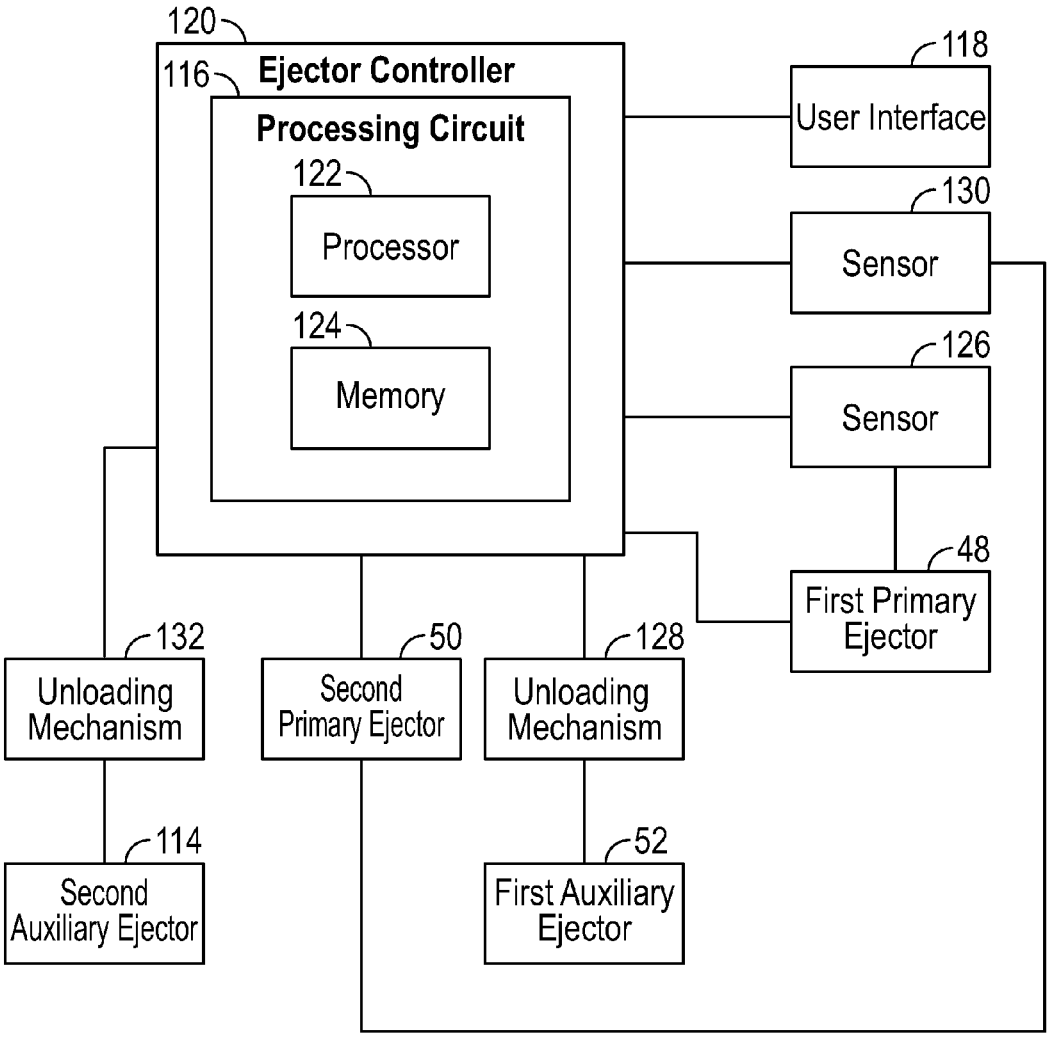
FIG. 36 is a control diagram for a first primary ejector, a second primary ejector, a first auxiliary ejector, and a second auxiliary ejector, according to an exemplary embodiment of the present disclosure.
Figure 37:
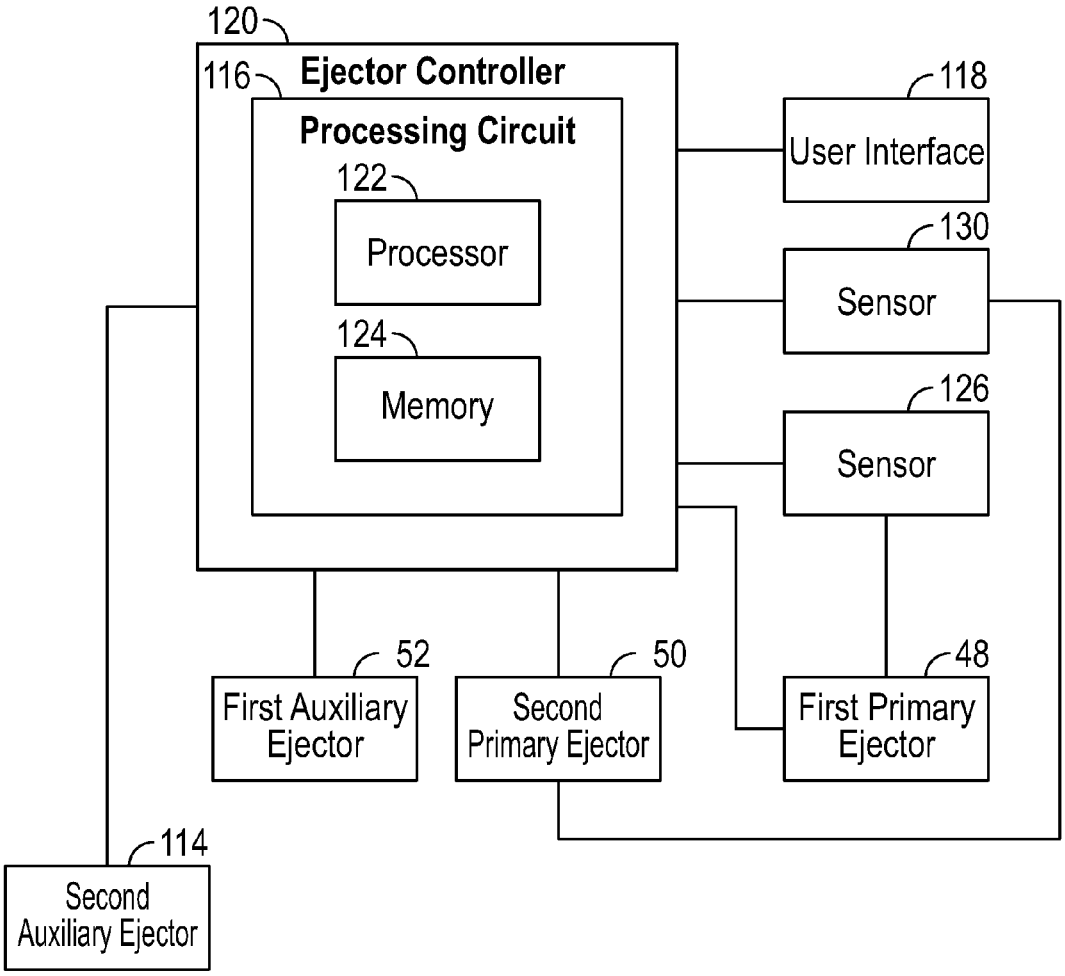
FIG. 37 is a control diagram for a first primary ejector, a second primary ejector, a first auxiliary ejector, and a second auxiliary ejector, according to an exemplary embodiment of the present disclosure.
Figure 38:
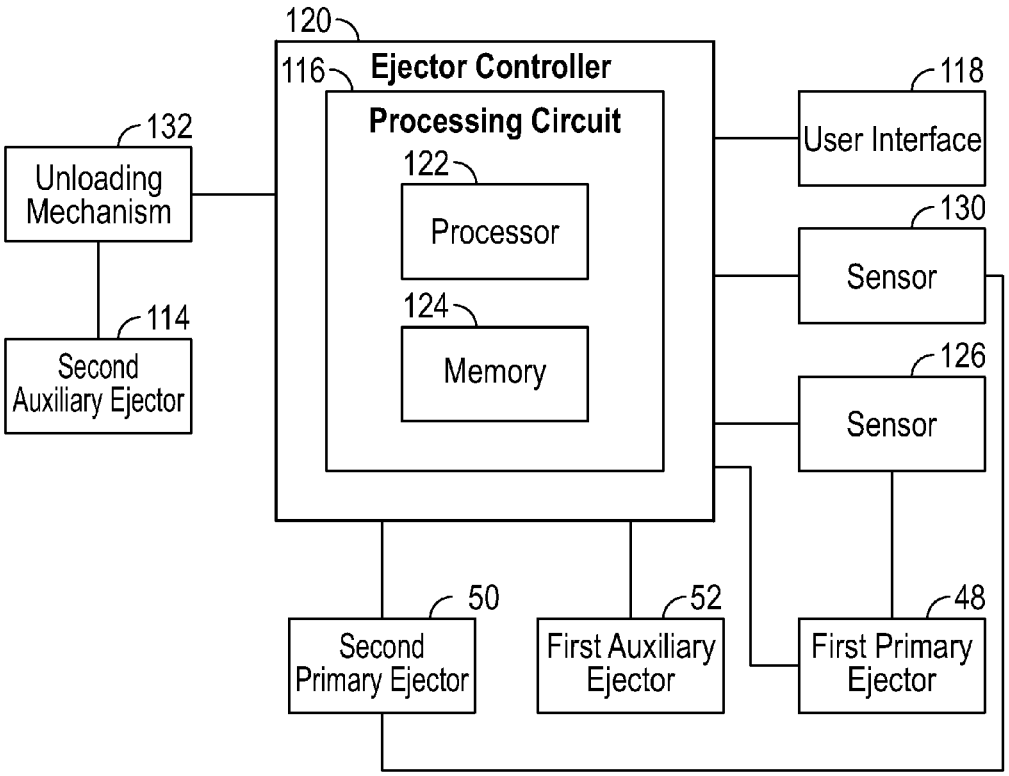
FIG. 38 is a control diagram for a first primary ejector, a second primary ejector, a first auxiliary ejector, and a second auxiliary ejector, according to an exemplary embodiment of the present disclosure.

Referring to FIG. 36, refuse vehicle 10 may further include a second unloading mechanism 132 and second auxiliary ejector 114. Unloading mechanism 132 may be an unloader valve, proximity sensor, cam actuated valve, switch, or other unloading mechanism, and may be thereby tailored for a target application. Memory 124 may include various information on unloading mechanism 132 including target points and actuation duration (i.e., the amount of time unloading mechanism 132 takes to actuate, etc.). Unloading mechanism 132 may receive signals from ejector controller 120 to instruct unloading mechanism 132 to decouple second auxiliary ejector 114 from second primary ejector 50. According to an exemplary embodiment, sensor 130 is configured to relay the position, or other desired parameter, of second primary ejector 50 to ejector controller 120 which will determine the proper course of action with respect to second auxiliary ejector 114. For example, if second primary ejector 50 is forward, relative to a primary direction of travel of refuse vehicle 10, of mid post 56, ejector controller 120 may ensure that second auxiliary ejector 114 is at its initial position. However, if second primary ejector 50 is at mid post 56, ejector controller 120 may couple second auxiliary ejector 114 to second primary ejector 50 using a second pickup, or may instruct a second actuator to begin to translate second auxiliary ejector 114.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps. contrariwise As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the multi-section refuse ejector as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A refuse vehicle, comprising:

a chassis including a frame and a cab disposed at one end of the frame;

a body including a hopper portion having a first width and a storage portion having a second width greater than the first width, wherein the hopper portion is positioned forward of the storage portion, between the storage portion and the cab;

a primary ejector having a width equal to the first width;

an auxiliary ejector having a width equal to the difference between the first width and the second width, wherein the primary ejector is selectively repositionable within the hopper portion and the storage portion of the body to at least one of compact refuse therein and eject refuse therefrom, and wherein the auxiliary ejector is selectively repositionable within the storage portion of the body to at least one of compact refuse therein and eject refuse therefrom in tandem with the primary ejector;

a pickup configured to selectively couple the primary ejector and the auxiliary ejector;

a sensor configured to provide data relating to a position of the primary ejector; and a controller configured to:

receive the data from the sensor; and control the pickup to decouple the primary ejector and the secondary ejector in response to an indication from the sensor that the primary ejector is positioned at the interface between the storage portion and the hopper portion.

2. The refuse vehicle of claim 1, further comprising a container handling system configured to lift and dump refuse from a refuse container into the hopper portion.

3. The refuse vehicle of claim 2, wherein the container handling system is positioned alongside the hopper portion and forward of the storage portion of the body, wherein the container handling system is configured to interface with refuse containers disposed to a side of the body such that the refuse vehicle is a side-loading refuse vehicle.

4. The refuse vehicle of claim 1, wherein the body includes a front post positioned at a front end of the hopper portion, a rear post positioned at a rear end of the storage portion, and a mid post positioned at the interface between the storage portion and the hopper portion.

5. The refuse vehicle of claim 4, further comprising an actuator positioned to selectively reposition the primary ejector between a first position at the front post, a second position at the mid post, and a third position at the rear post.

6. The refuse vehicle of claim 5, further comprising a second actuator positioned to selectively reposition the auxiliary ejector between the mid post and the rear post.

7. The refuse vehicle of claim 1, wherein the pickup comprises a locking plate, a catch, and an actuator configured to selectively engage the catch with the locking plate.

8. The refuse vehicle of claim 1, wherein the storage portion of the body has a width equal to 102 inches.

9. A refuse vehicle, comprising:

a chassis including a frame and a cab disposed at one end of the frame;

a body including a hopper portion having a first width and a storage portion having a second width greater than the first width, wherein the hopper portion is positioned forward of the storage portion, between the storage portion and the cab;

a primary ejector having a width that corresponds with the first width;

an auxiliary ejector, wherein the combined widths of the primary ejector and the auxiliary ejector correspond with the second width, wherein the primary ejector is selectively repositionable along a primary ejector track extending through the hopper portion and the storage portion and wherein the auxiliary ejector is selectively repositionable along an auxiliary ejector track extending through the storage portion;

a first actuator directly coupled to both the body and the primary ejector, the first actuator configured to selectively reposition the primary ejector along the primary ejector track; and a second actuator directly coupled to both the body and the auxiliary ejector, the second actuator configured to selectively reposition the auxiliary ejector along the auxiliary ejector track.

10. The refuse vehicle of claim 9, further comprising a container handling system configured to lift and dump refuse from a refuse container into the hopper portion.

11. The refuse vehicle of claim 10, wherein the container handling system is positioned alongside the hopper portion and forward of the storage portion of the body, wherein the container handling system is configured to interface with refuse containers disposed to a side of the body such that the refuse vehicle is a side-loading refuse vehicle.

12. The refuse vehicle of claim 11, wherein at least one of the primary ejector and the auxiliary ejector include a pickup configured to selectively couple the primary ejector and the auxiliary ejector such that movement of the primary ejector due to engagement of the first actuator also repositions the auxiliary ejector.

13. The refuse vehicle of claim 12, wherein the pickup comprises a locking plate, a catch, and a third actuator configured to selectively engage the catch with the locking plate.

14. A side-loading refuse vehicle, comprising:

a chassis including a frame and a cab disposed at one end of the frame;

a body including a storage portion and a hopper portion positioned between the storage portion and the cab, wherein a wall of the body that defines the hopper portion is inset relative to a wall of the body that defines the storage portion such that the body defines a space between the storage portion and the cab, alongside the hopper portion, that is configured to receive a container handling system;

at least two ejectors, wherein a first of the ejectors has a first sweep area extending through the hopper portion and one lateral side of the storage portion of the body, the first sweep area narrower than the storage portion of the body, wherein a second of the ejectors has a second sweep area extending through a second lateral side of the storage body, and wherein the second sweep area is disposed rearward of the space defined by the body that is configured to receive the container handling system such that the second ejector sweeps a dead zone not accessible to the first ejector;

a first actuator coupled to the body and the first ejector, the first actuator configured to selectively reposition the first ejector within the first sweep area;

a second actuator coupled to the body and the second ejector, the second actuator configured to selectively reposition the second ejector within the second sweep area;

a pickup configured to selectively couple the first ejector and the second ejector;

a sensor configured to provide data relating to a position of the first ejector; and a controller configured to:

receive the data from the sensor; and control the pickup to decouple the primary ejector and the secondary ejector in response to an indication from the sensor that the primary ejector is positioned at the interface between the storage portion and the hopper portion.

15. The side-loading refuse vehicle of claim 14, further comprising a container handling system configured to lift and dump refuse from a refuse container into the hopper portion, wherein the container handling system is positioned within the space defined by the body.

16. The side-loading refuse vehicle of claim 14, wherein the pickup comprises a locking plate, a catch, and a third actuator configured to selectively engage the catch with the locking plate.

* * * * *